US008366024B2

(12) United States Patent
Leber

(10) Patent No.: US 8,366,024 B2
(45) Date of Patent: Feb. 5, 2013

(54) LOW SPEED PULSATING SHOWERHEAD

(75) Inventor: Leland C. Leber, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 11/964,670

(22) Filed: Dec. 26, 2007

(65) Prior Publication Data

US 2008/0156897 A1 Jul. 3, 2008

Related U.S. Application Data

(60) Provisional application No. 60/882,441, filed on Dec. 28, 2006.

(51) Int. Cl.
*B05B 3/04* (2006.01)

(52) U.S. Cl. ..... 239/381; 239/558; 239/562

(58) Field of Classification Search ..... 239/237–242, 239/380–383, 482–484, 487, 488, 491–497, 239/533.15, 556–564
See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 453,109 | A | 5/1891 | Dreisorner |
| 486,986 | A | 11/1892 | Schinke |
| 566,384 | A | 8/1896 | Engelhart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |
| 835,678 | A | 11/1906 | Hammond |
| 845,540 | A | 2/1907 | Ferguson |
| 854,094 | A | 5/1907 | Klein |
| 926,929 | A | 7/1909 | Dusseau |
| 1,001,842 | A | 8/1911 | Greenfield |

(Continued)

FOREIGN PATENT DOCUMENTS

| | | |
|---|---|---|
| CA | 659510 | 3/1963 |
| CA | 2341041 | 8/1999 |

(Continued)

OTHER PUBLICATIONS

International Search Report, PCT/US07/88962, 9 pages, Jun. 10, 2008.

(Continued)

*Primary Examiner* — Christopher Kim
(74) *Attorney, Agent, or Firm* — Dorsey & Whitney LLP

(57) ABSTRACT

A showerhead may include a housing, a jet disk, a turbine, and a shutter. The housing may include a fluid inlet, at least one fluid outlet, and a chamber in fluid communication with the inlet and one or more outlets. The jet disk, turbine, and shutter may be placed in the cavity. The shutter may include at least one opening. The shutter may selectively cover and uncover fluid outlets, thus selectively fluidly connecting the fluid outlets with the chamber. Water flowing through the housing causes the turbine to spin. As the turbine spins, the shutter rotates at a slower speed than the turbine to produce a periodic interruption of water flow through the outlets by covering and uncovering the outlets as the shutter rotates within the housing.

20 Claims, 15 Drawing Sheets

U.S. PATENT DOCUMENTS

| | | | |
|---|---|---|---|
| 1,003,037 | A | 9/1911 | Crowe |
| 1,018,143 | A | 2/1912 | Vissering |
| 1,046,573 | A | 12/1912 | Ellis |
| 1,130,520 | A | 3/1915 | Kenney |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 12/1928 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A * | 9/1966 | Coson ..... 239/206 |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope |
| 3,637,143 | A | 1/1972 | Shames et al. |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-Koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Juhlin |
| 3,762,648 | A | 10/1973 | Deines et al. |
| 3,768,735 | A | 10/1973 | Ward |
| 3,786,995 | A | 1/1974 | Manoogian et al. |
| 3,801,019 | A | 4/1974 | Trenary et al. |
| 3,810,580 | A | 5/1974 | Rauh |
| 3,826,454 | A | 7/1974 | Zieger |
| 3,840,734 | A | 10/1974 | Oram |
| 3,845,291 | A | 10/1974 | Portyrata |
| 3,860,271 | A | 1/1975 | Rodgers |
| 3,861,719 | A | 1/1975 | Hand |
| 3,865,310 | A | 2/1975 | Elkins et al. |
| 3,869,151 | A | 3/1975 | Fletcher et al. |
| 3,896,845 | A | 7/1975 | Parker |
| 3,902,671 | A | 9/1975 | Symmons |
| 3,910,277 | A | 10/1975 | Zimmer |
| D237,708 | S | 11/1975 | Grohe |
| 3,929,164 | A | 12/1975 | Richter |
| 3,929,287 | A | 12/1975 | Givler et al. |
| 3,958,756 | A | 5/1976 | Trenary et al. |
| D240,322 | S | 6/1976 | Staub |
| 3,967,783 | A | 7/1976 | Halsted et al. |
| 3,979,096 | A | 9/1976 | Zieger |

3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,239,409 A 12/1980 Osrow
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E * 3/1987 Hunter ..... 239/206
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,717,180 A 1/1988 Roman
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.
D317,348 S 6/1991 Geneve et al.
5,020,570 A 6/1991 Cotter
5,022,103 A 6/1991 Faist
5,032,015 A 7/1991 Christianson
5,033,528 A 7/1991 Volcani
5,033,897 A 7/1991 Chen
D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen 5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A * 3/1995 Heitzman ..... 239/99
5,398,872 A 3/1995 Joubran
5,398,977 A 3/1995 Berger et al.
5,402,812 A 4/1995 Moineau et al.
5,405,089 A 4/1995 Heimann et al.
5,414,879 A 5/1995 Hiraishi et al.
5,423,348 A 6/1995 Jezek et al.
5,433,384 A 7/1995 Chan et al.
D361,399 S 8/1995 Carbone et al.
D361,623 S 8/1995 Huen
5,441,075 A 8/1995 Clare
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova
D365,646 S 12/1995 deBlois
5,476,225 A 12/1995 Chan
D366,309 S 1/1996 Huang
D366,707 S 1/1996 Kaiser
D366,708 S 1/1996 Santarsiero
D366,709 S 1/1996 Szmanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.
D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.
D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan

| | | | |
|---|---|---|---|
| D371,619 | S | 7/1996 | Szymanski |
| D371,856 | S | 7/1996 | Carbone |
| D372,318 | S | 7/1996 | Szymanski |
| D372,319 | S | 7/1996 | Carbone |
| 5,531,625 | A | 7/1996 | Zhong |
| 5,539,624 | A | 7/1996 | Dougherty |
| D372,548 | S | 8/1996 | Carbone |
| D372,998 | S | 8/1996 | Carbone |
| D373,210 | S | 8/1996 | Santarsiero |
| D373,434 | S | 9/1996 | Nolan |
| D373,435 | S | 9/1996 | Nolan |
| D373,645 | S | 9/1996 | Johnstone et al. |
| D373,646 | S | 9/1996 | Szymanski et al. |
| D373,647 | S | 9/1996 | Kaiser |
| D373,648 | S | 9/1996 | Kaiser |
| D373,649 | S | 9/1996 | Carbone |
| D373,651 | S | 9/1996 | Szymanski |
| D373,652 | S | 9/1996 | Kaiser |
| 5,551,637 | A | 9/1996 | Lo |
| 5,552,973 | A | 9/1996 | Hsu |
| 5,558,278 | A | 9/1996 | Gallorini |
| D374,271 | S | 10/1996 | Fleischmann |
| D374,297 | S | 10/1996 | Kaiser |
| D374,298 | S | 10/1996 | Swyst |
| D374,299 | S | 10/1996 | Carbone |
| D374,493 | S | 10/1996 | Szymanski |
| D374,494 | S | 10/1996 | Santarsiero |
| D374,732 | S | 10/1996 | Kaiser |
| D374,733 | S | 10/1996 | Santasiero |
| 5,560,548 | A | 10/1996 | Mueller et al. |
| 5,567,115 | A | 10/1996 | Carbone |
| D375,541 | S | 11/1996 | Michaluk |
| 5,577,664 | A | 11/1996 | Heitzman |
| D376,217 | S | 12/1996 | Kaiser |
| D376,860 | S | 12/1996 | Santarsiero |
| D376,861 | S | 12/1996 | Johnstone et al. |
| D376,862 | S | 12/1996 | Carbone |
| 5,605,173 | A | 2/1997 | Arnaud |
| D378,401 | S | 3/1997 | Neufeld et al. |
| 5,613,638 | A | 3/1997 | Blessing |
| 5,613,639 | A | 3/1997 | Storm et al. |
| 5,615,837 | A | 4/1997 | Roman |
| 5,624,074 | A | 4/1997 | Parisi |
| 5,624,498 | A | 4/1997 | Lee et al. |
| D379,212 | S | 5/1997 | Chan |
| D379,404 | S | 5/1997 | Spelts |
| 5,632,049 | A | 5/1997 | Chen |
| D381,405 | S | 7/1997 | Waidele et al. |
| D381,737 | S | 7/1997 | Chan |
| D382,936 | S | 8/1997 | Shfaram |
| 5,653,260 | A | 8/1997 | Huber |
| 5,667,146 | A | 9/1997 | Pimentel et al. |
| D385,332 | S | 10/1997 | Andrus |
| D385,333 | S | 10/1997 | Caroen et al. |
| D385,334 | S | 10/1997 | Caroen et al. |
| D385,616 | S | 10/1997 | Dow et al. |
| D385,947 | S | 11/1997 | Dow et al. |
| D387,230 | S | 12/1997 | von Buelow et al. |
| 5,697,557 | A | 12/1997 | Blessing et al. |
| 5,699,964 | A | 12/1997 | Bergmann et al. |
| 5,702,057 | A | 12/1997 | Huber |
| D389,558 | S | 1/1998 | Andrus |
| 5,704,080 | A | 1/1998 | Kuhne |
| 5,707,011 | A | 1/1998 | Bosio |
| 5,718,380 | A | 2/1998 | Schorn et al. |
| D392,369 | S | 3/1998 | Chan |
| 5,730,361 | A | 3/1998 | Thonnes |
| 5,730,362 | A | 3/1998 | Cordes |
| 5,730,363 | A | 3/1998 | Kress |
| 5,742,961 | A | 4/1998 | Casperson et al. |
| D394,490 | S | 5/1998 | Andrus et al. |
| 5,746,375 | A | 5/1998 | Guo |
| 5,749,552 | A | 5/1998 | Fan |
| 5,749,602 | A | 5/1998 | Delaney et al. |
| D394,899 | S | 6/1998 | Caroen et al. |
| D395,074 | S | 6/1998 | Neibrook |
| D395,075 | S | 6/1998 | Kolada |
| D395,142 | S | 6/1998 | Neibrook |
| 5,764,760 | A | 6/1998 | Grandbert et al. |
| 5,765,760 | A | 6/1998 | Kuo |
| 5,769,802 | A | 6/1998 | Wang |
| 5,772,120 | A | 6/1998 | Huber |
| 5,778,939 | A | 7/1998 | Hok-Yin |
| 5,788,157 | A | 8/1998 | Kress |
| D398,370 | S | 9/1998 | Purdy |
| 5,806,771 | A | 9/1998 | Loschelder et al. |
| 5,819,791 | A | 10/1998 | Chronister et al. |
| 5,820,574 | A | 10/1998 | Henkin et al. |
| 5,823,431 | A | 10/1998 | Pierce |
| 5,823,442 | A | 10/1998 | Guo |
| 5,826,803 | A | 10/1998 | Cooper |
| 5,833,138 | A | 11/1998 | Crane et al. |
| 5,839,666 | A | 11/1998 | Heimann et al. |
| D402,350 | S | 12/1998 | Andrus |
| D403,754 | S | 1/1999 | Gottwald |
| D404,116 | S | 1/1999 | Bosio |
| 5,855,348 | A | 1/1999 | Fornara |
| 5,860,599 | A | 1/1999 | Lin |
| 5,862,543 | A | 1/1999 | Reynoso et al. |
| 5,862,985 | A | 1/1999 | Neibrook et al. |
| D405,502 | S | 2/1999 | Tse |
| 5,865,375 | A | 2/1999 | Hsu |
| 5,865,378 | A | 2/1999 | Hollinshead et al. |
| 5,873,647 | A | 2/1999 | Kurtz et al. |
| D408,893 | S | 4/1999 | Tse |
| D409,276 | S | 5/1999 | Ratzlaff |
| D410,276 | S | 5/1999 | Ben-Tsur |
| 5,918,809 | A | 7/1999 | Simmons |
| 5,918,811 | A | 7/1999 | Denham et al. |
| D413,157 | S | 8/1999 | Ratzlaff |
| 5,937,905 | A | 8/1999 | Santos |
| 5,938,123 | A | 8/1999 | Heitzman |
| 5,941,462 | A | 8/1999 | Sandor |
| 5,947,388 | A | 9/1999 | Woodruff |
| D415,247 | S | 10/1999 | Haverstraw et al. |
| 5,961,046 | A | 10/1999 | Joubran |
| 5,967,417 | A | 10/1999 | Mantel |
| 5,979,776 | A | 11/1999 | Williams |
| 5,992,762 | A | 11/1999 | Wang |
| D418,200 | S | 12/1999 | Ben-Tsur |
| 5,997,047 | A | 12/1999 | Pimentel et al. |
| 6,003,165 | A | 12/1999 | Loyd |
| D418,902 | S | 1/2000 | Haverstraw et al. |
| D418,903 | S | 1/2000 | Haverstraw et al. |
| D418,904 | S | 1/2000 | Milrud |
| D421,099 | S | 2/2000 | Mullenmeister |
| 6,021,960 | A | 2/2000 | Kehat |
| D422,053 | S | 3/2000 | Brenner et al. |
| 6,042,027 | A | 3/2000 | Sandvik |
| 6,042,155 | A | 3/2000 | Lockwood |
| D422,336 | S | 4/2000 | Haverstraw et al. |
| D422,337 | S | 4/2000 | Chan |
| D423,083 | S | 4/2000 | Haug et al. |
| D423,110 | S | 4/2000 | Cipkowski |
| D424,160 | S | 5/2000 | Haug et al. |
| D424,161 | S | 5/2000 | Haug et al. |
| D424,162 | S | 5/2000 | Haug et al. |
| D424,163 | S | 5/2000 | Haug et al. |
| D426,290 | S | 6/2000 | Haug et al. |
| D427,661 | S | 7/2000 | Haverstraw et al. |
| D428,110 | S | 7/2000 | Haug et al. |
| D428,125 | S | 7/2000 | Chan |
| 6,085,780 | A | 7/2000 | Morris |
| D430,267 | S | 8/2000 | Milrud et al. |
| 6,095,801 | A | 8/2000 | Spiewak |
| D430,643 | S | 9/2000 | Tse |
| 6,113,002 | A | 9/2000 | Finkbeiner |
| 6,123,272 | A | 9/2000 | Havican et al. |
| 6,123,308 | A | 9/2000 | Faisst |
| D432,624 | S | 10/2000 | Chan |
| D432,625 | S | 10/2000 | Chan |
| D433,096 | S | 10/2000 | Tse |
| D433,097 | S | 10/2000 | Tse |
| 6,126,091 | A | 10/2000 | Heitzman |
| 6,126,290 | A | 10/2000 | Veigel |
| D434,109 | S | 11/2000 | Ko |
| 6,164,569 | A | 12/2000 | Hollinshead et al. |
| 6,164,570 | A | 12/2000 | Smeltzer |

D435,889 S 1/2001 Ben-Tsur et al.
D439,305 S 3/2001 Slothower
6,199,580 B1 3/2001 Morris
6,202,679 B1 3/2001 Titus
D440,276 S 4/2001 Slothower
D440,277 S 4/2001 Slothower
D440,278 S 4/2001 Slothower
D441,059 S 4/2001 Fleischmann
6,209,799 B1 4/2001 Finkbeiner
D443,025 S 5/2001 Kollmann et al.
D443,026 S 5/2001 Kollmann et al.
D443,027 S 5/2001 Kollmann et al.
D443,029 S 5/2001 Kollmann et al.
6,223,998 B1 5/2001 Heitzman
6,230,984 B1 5/2001 Jager
6,230,988 B1 5/2001 Chao
6,230,989 B1 5/2001 Haverstraw et al.
D443,335 S 6/2001 Andrus
D443,336 S 6/2001 Kollmann et al.
D443,347 S 6/2001 Gottwald
6,241,166 B1 6/2001 Overington et al.
6,250,572 B1 6/2001 Chen
D444,865 S 7/2001 Gottwald
D445,871 S 7/2001 Fan
6,254,014 B1 7/2001 Clearman et al.
6,270,278 B1 8/2001 Mauro
6,276,004 B1 8/2001 Bertrand et al.
6,283,447 B1 9/2001 Fleet
6,286,764 B1 9/2001 Garvey et al.
D449,673 S 10/2001 Kollmann et al.
D450,370 S 11/2001 Wales et al.
D450,805 S 11/2001 Lindholm et al.
D450,806 S 11/2001 Lindholm et al.
D450,807 S 11/2001 Lindholm et al.
D451,169 S 11/2001 Lindholm et al.
D451,170 S 11/2001 Lindholm et al.
D451,171 S 11/2001 Lindholm et al.
D451,172 S 11/2001 Lindholm et al.
6,321,777 B1 11/2001 Wu
6,322,006 B1 11/2001 Guo
D451,583 S 12/2001 Lindholm et al.
D451,980 S 12/2001 Lindholm et al.
D452,553 S 12/2001 Lindholm et al.
D452,725 S 1/2002 Lindholm et al.
D452,897 S 1/2002 Gillette et al.
6,336,764 B1 1/2002 Liu
D453,369 S 2/2002 Lobermeier
D453,370 S 2/2002 Lindholm et al.
D453,551 S 2/2002 Lindholm et al.
6,349,735 B2 2/2002 Gul
D454,617 S 3/2002 Curbbun et al.
D454,938 S 3/2002 Lord
6,375,342 B1 4/2002 Koren et al.
D457,937 S 5/2002 Lindholm et al.
6,382,531 B1 5/2002 Tracy
D458,348 S 6/2002 Mullenmeister
6,412,711 B1 7/2002 Fan
D461,224 S 8/2002 Lobermeier
D461,878 S 8/2002 Green et al.
6,450,425 B1 9/2002 Chen
6,454,186 B2 9/2002 Haverstraw et al.
6,463,658 B1 10/2002 Larsson
6,464,265 B1 10/2002 Mikol
D465,552 S 11/2002 Tse
D465,553 S 11/2002 Singtoroj
6,484,952 B2 11/2002 Koren
D468,800 S 1/2003 Tse
D469,165 S 1/2003 Lim
6,502,796 B1 1/2003 Wales
6,508,415 B2 1/2003 Wang
6,511,001 B1 1/2003 Huang
D470,219 S 2/2003 Schweitzer
6,516,070 B2 2/2003 Macey
D471,253 S 3/2003 Tse
D471,953 S 3/2003 Colligan et al.
6,533,194 B2 3/2003 Marsh et al.
6,537,455 B2 3/2003 Farley
D472,958 S 4/2003 Ouyoung
6,550,697 B2 4/2003 Lai
6,585,174 B1 7/2003 Huang
6,595,439 B1 7/2003 Chen
6,607,148 B1 8/2003 Marsh et al.
6,611,971 B1 9/2003 Antoniello et al.
6,637,676 B2 10/2003 Zieger et al.
6,641,057 B2 11/2003 Thomas et al.
D483,837 S 12/2003 Fan
6,659,117 B2 12/2003 Gilmore
6,659,372 B2 12/2003 Marsh et al.
D485,887 S 1/2004 Luettgen et al.
D486,888 S 2/2004 Lobermeier
6,691,338 B2 2/2004 Zieger
6,691,933 B1 2/2004 Bosio
D487,301 S 3/2004 Haug et al.
D487,498 S 3/2004 Blomstrom
6,701,953 B2 3/2004 Agosta
6,715,699 B1 4/2004 Greenberg et al.
6,719,218 B2 4/2004 Cool et al.
D489,798 S 5/2004 Hunt
D490,498 S 5/2004 Golichowski
6,736,336 B2 5/2004 Wong
6,739,523 B2 5/2004 Haverstraw et al.
6,739,527 B1 5/2004 Chung
D492,004 S 6/2004 Haug et al.
D492,007 S 6/2004 Kollmann et al.
6,742,725 B1 6/2004 Fan
D493,208 S 7/2004 Lin
D493,864 S 8/2004 Haug et al.
D494,655 S 8/2004 Lin
D494,661 S 8/2004 Zieger et al.
D495,027 S 8/2004 Mazzola
6,776,357 B1 8/2004 Naito
6,789,751 B1 9/2004 Fan
D496,987 S 10/2004 Glunk
D497,974 S 11/2004 Haug et al.
D498,514 S 11/2004 Haug et al.
D500,121 S 12/2004 Blomstrom
D500,549 S 1/2005 Blomstrom
D501,242 S 1/2005 Blomstrom
D502,760 S 3/2005 Zieger et al.
D502,761 S 3/2005 Zieger et al.
D503,211 S 3/2005 Lin
6,863,227 B2 3/2005 Wollenberg et al.
6,869,030 B2 3/2005 Blessing et al.
D503,774 S 4/2005 Zieger
D503,775 S 4/2005 Zieger
D503,966 S 4/2005 Zieger
6,899,292 B2 5/2005 Titinet
D506,243 S 6/2005 Wu
D507,037 S 7/2005 Wu
6,935,581 B2 8/2005 Titinet
D509,280 S 9/2005 Bailey et al.
D509,563 S 9/2005 Bailey et al.
D510,123 S 9/2005 Tsai
D511,809 S 11/2005 Haug et al.
D512,119 S 11/2005 Haug et al.
6,981,661 B1 1/2006 Chen
D516,169 S 2/2006 Wu
7,004,409 B2 2/2006 Okubo
7,004,410 B2 2/2006 Li
D520,109 S 5/2006 Wu
7,040,554 B2 5/2006 Drennow
7,048,210 B2 5/2006 Clark
7,055,767 B1 6/2006 Ko
7,070,125 B2 7/2006 Williams et al.
7,077,342 B2 7/2006 Lee
D527,440 S 8/2006 Macan
7,093,780 B1 8/2006 Chung
7,097,122 B1 8/2006 Farley
D528,631 S 9/2006 Gillette et al.
7,100,845 B1 9/2006 Hsieh
7,111,795 B2 9/2006 Thong
7,111,798 B2 9/2006 Thomas et al.
D530,389 S 10/2006 Genslak et al.
D530,392 S 10/2006 Tse
D531,259 S 10/2006 Hsieh
7,114,666 B2 10/2006 Luettgen et al.
D533,253 S 12/2006 Luettgen et al.
D534,239 S 12/2006 Dingler et al.

| | | | |
|---|---|---|---|
| D535,354 | S | 1/2007 | Wu |
| D536,060 | S | 1/2007 | Sadler |
| 7,156,325 | B1 | 1/2007 | Chen |
| D538,391 | S | 3/2007 | Mazzola |
| D540,424 | S | 4/2007 | Kirar |
| D540,425 | S | 4/2007 | Endo et al. |
| D540,426 | S | 4/2007 | Cropelli |
| D540,427 | S | 4/2007 | Bouroullec et al. |
| D542,391 | S | 5/2007 | Gilbert |
| D542,393 | S | 5/2007 | Haug et al. |
| 7,229,031 | B2 | 6/2007 | Schmidt |
| 7,243,863 | B2 | 7/2007 | Glunk |
| 7,246,760 | B2 | 7/2007 | Marty et al. |
| D552,713 | S | 10/2007 | Rexach |
| 7,278,591 | B2 | 10/2007 | Clearman et al. |
| D556,295 | S | 11/2007 | Genord et al. |
| 7,299,510 | B2 | 11/2007 | Tsai |
| D557,763 | S | 12/2007 | Schonherr et al. |
| D557,764 | S | 12/2007 | Schonherr et al. |
| D557,765 | S | 12/2007 | Schonherr et al. |
| D558,301 | S | 12/2007 | Hoernig |
| 7,303,151 | B2 | 12/2007 | Wu |
| D559,357 | S | 1/2008 | Wang et al. |
| D559,945 | S | 1/2008 | Patterson et al. |
| D560,269 | S | 1/2008 | Tse |
| D562,937 | S | 2/2008 | Schonherr et al. |
| D562,938 | S | 2/2008 | Blessing |
| D562,941 | S | 2/2008 | Pan |
| 7,331,536 | B1 | 2/2008 | Zhen et al. |
| 7,347,388 | B2 | 3/2008 | Chung |
| D565,699 | S | 4/2008 | Berberet |
| D565,703 | S | 4/2008 | Lammel et al. |
| D566,228 | S | 4/2008 | Neagoe |
| D566,229 | S | 4/2008 | Rexach |
| D567,328 | S | 4/2008 | Spangler et al. |
| 7,360,723 | B2 | 4/2008 | Lev |
| 7,364,097 | B2 | 4/2008 | Okuma |
| 7,374,112 | B1 | 5/2008 | Bulan et al. |
| 7,384,007 | B2 | 6/2008 | Ho |
| D577,099 | S | 9/2008 | Leber |
| D577,793 | S | 9/2008 | Leber |
| D580,012 | S | 11/2008 | Quinn et al. |
| D580,513 | S | 11/2008 | Quinn et al. |
| D581,014 | S | 11/2008 | Quinn et al. |
| 7,503,345 | B2 | 3/2009 | Paterson et al. |
| 7,520,448 | B2 | 4/2009 | Luettgen et al. |
| 7,537,175 | B2 | 5/2009 | Miura et al. |
| D608,412 | S | 1/2010 | Barnard et al. |
| D608,413 | S | 1/2010 | Barnard et al. |
| D616,061 | S | 5/2010 | Whitaker et al. |
| D621,904 | S | 8/2010 | Yoo et al. |
| D621,905 | S | 8/2010 | Yoo et al. |
| 7,832,662 | B2 | 11/2010 | Gallo |
| D628,676 | S | 12/2010 | Lee |
| D629,867 | S | 12/2010 | Rexach et al. |
| 2002/0109023 | A1 | 8/2002 | Thomas et al. |
| 2003/0062426 | A1 | 4/2003 | Gregory et al. |
| 2004/0074993 | A1 | 4/2004 | Thomas et al. |
| 2004/0118949 | A1 | 6/2004 | Marks |
| 2004/0217209 | A1 | 11/2004 | Bui |
| 2004/0244105 | A1 | 12/2004 | Tsai |
| 2005/0001072 | A1 | 1/2005 | Bolus et al. |
| 2005/0082824 | A1 | 4/2005 | Luettgen et al. |
| 2005/0284967 | A1 | 12/2005 | Korb et al. |
| 2006/0016908 | A1 | 1/2006 | Chung |
| 2006/0016913 | A1 | 1/2006 | Lo |
| 2006/0043214 | A1 | 3/2006 | Macan et al. |
| 2006/0060678 | A1 | 3/2006 | Mazzola |
| 2006/0102747 | A1 | 5/2006 | Ho |
| 2006/0157590 | A1 | 7/2006 | Clearman et al. |
| 2006/0163391 | A1 | 7/2006 | Schorn |
| 2006/0219822 | A1 | 10/2006 | Miller et al. |
| 2006/0283986 | A1 | 12/2006 | Chung |
| 2007/0040054 | A1 | 2/2007 | Farzan |
| 2007/0200013 | A1 | 8/2007 | Hsiao |
| 2007/0246577 | A1 | 10/2007 | Leber |
| 2007/0252021 | A1 | 11/2007 | Cristina |
| 2007/0272770 | A1 | 11/2007 | Leber et al. |
| 2008/0073449 | A1 | 3/2008 | Haynes et al. |
| 2008/0083844 | A1 | 4/2008 | Leber et al. |
| 2008/0111004 | A1 | 5/2008 | Huffman |
| 2008/0121293 | A1 | 5/2008 | Leber |
| 2008/0156902 | A1 | 7/2008 | Luettgen et al. |
| 2008/0156903 | A1 | 7/2008 | Leber |
| 2008/0223957 | A1 | 9/2008 | Schorn |
| 2008/0272203 | A1 | 11/2008 | Leber |
| 2008/0272591 | A1 | 11/2008 | Leber |
| 2009/0200404 | A1 | 8/2009 | Cristina |
| 2009/0218420 | A1 | 9/2009 | Mazzola |
| 2009/0307836 | A1 | 12/2009 | Blattner et al. |
| 2010/0320290 | A1 | 12/2010 | Luettgen et al. |
| 2011/0000982 | A1 | 1/2011 | Luettgen et al. |
| 2011/0000983 | A1 | 1/2011 | Chang |
| 2011/0011953 | A1 | 1/2011 | Macan et al. |

FOREIGN PATENT DOCUMENTS

| | | |
|---|---|---|
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 7/1988 |
| DE | 4034695 | 5/1991 |
| DE | 19608085 | 9/1996 |
| DE | 202005000881 | 3/2005 |
| DE | 102006032017 | 1/2008 |
| EP | 0167063 | 6/1985 |
| EP | 0478999 | 4/1992 |
| EP | 0514753 | 11/1992 |
| EP | 0435030 | 7/1993 |
| EP | 0617644 | 10/1994 |
| EP | 0683354 | 11/1995 |
| EP | 0687851 | 12/1995 |
| EP | 0695907 | 2/1996 |
| EP | 0700729 | 3/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| EP | 2164642 | 10/2010 |
| EP | 2260945 | 12/2010 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 3314 | 0/1914 |
| GB | 10086 | 0/1894 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |
| GB | 2199771 | 7/1988 |
| GB | 2298595 | 11/1996 |
| GB | 2337471 | 11/1999 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |

| | | |
|---|---|---|
| JP | 4062238 | 2/1992 |
| JP | 4146708 | 5/1992 |
| NL | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO99/59726 | 11/1999 |
| WO | WO00/10720 | 3/2000 |
| WO | WO10/04593 | 1/2010 |

OTHER PUBLICATIONS

Color Copy Labeled 1A, Gemlo, available at least as early as Dec. 2, 1998.

Color Copy Labeled 1B, Gemlo, available at least as early as Dec. 2, 1998.

Author Unknown, "Flipside: The Bolder Look of Kohler," 1 page, at least as early as Jun. 2011.

* cited by examiner

LOW SPEED PULSATING SHOWERHEAD

CROSS-REFERENCE TO RELATED APPLICATIONS

This application claims the benefit under 35 U.S.C. §119 (e) to U.S. Provisional Application No. 60/882,441, titled "Low Speed Pulsating Shower Head" and filed on Dec. 28, 2006, which is hereby incorporated by reference herein in its entirety.

BACKGROUND OF THE INVENTION

1. Field of the Invention

The present invention relates generally to showerheads, and more specifically to pulsating showerheads.

2. Background Art

Generally, showerheads are used to direct water from the home water supply onto a user for personal hygiene purposes. Showers may provide an alternative to bathing in a bath tub.

In the past, bathing was the overwhelmingly popular choice for personal cleansing. However, in recent years showers have become increasingly popular for several reasons. First, showers generally take less time than baths. Second, showers generally use significantly less water than baths. Third, shower stalls and bath tubs with showerheads are typically easier to maintain. Fourth, showers tend to cause less soap scum build-up.

With the increase in popularity of showers has come an increase in showerhead designs and showerhead manufacturers. Many showerheads, for example, may emit pulsating streams of water in a so-called "massage" mode. Yet others are referred to as "drenching" showerheads, since they have relatively large faceplates and emit water in a steady, soft spray pattern.

BRIEF SUMMARY OF THE INVENTION

Various embodiments of a showerhead may include a housing, a turbine, and a shutter. The housing may define a chamber in fluid communication with a fluid inlet and at least one fluid outlet. The turbine may be received within the chamber. The shutter may be received within the chamber and operatively associated with the turbine. Rotation of the turbine may cause rotation of the shutter. A rotation rate of the shutter may be less than a rotation rate of the turbine. As the shutter rotates, the shutter may fluidly connect and disconnect the fluid inlet and the at least one fluid outlet.

In some showerhead embodiments, the housing may include a first engagement feature, the shutter may include a second engagement feature, and engagement of the first engagement feature with the second engagement feature may cause the rotation rate of the shutter to be less than the rotation rate of the turbine. The first engagement feature, the second engagement feature, or both, may be at least one gear tooth.

In yet further showerhead embodiments, the shutter may include at least one opening, and the at least one opening may fluidly connect and disconnect the fluid inlet and the at least one fluid outlet. In yet more showerhead embodiments, the shutter may include a disk and an integer number of first features distributed around a periphery of the disk, the housing may include an integer number of second features incorporated within an inner surface of the housing defining the chamber, the number of first features may be different than the number of second features, and rotation of the shutter may selectively engage the first features with the second features.

DETAILED DESCRIPTION

Described herein are showerheads for generating a relatively low speed pulsating spray. The showerheads may include a jet disk, a turbine, a shutter, and a housing. Water flowing through the showerhead causes the turbine to spin. As the turbine spins, it rotates the shutter. The shutter may be configured to rotate at a slower speed than the turbine to produce a periodic interruption of water flow through outlets or nozzles defined in, or attached to, the housing to create a pulsating spray. This pulsating spray may simulate the feel of a hand massage.

The shutter may take the form of a generally circular disk including gear teeth that selectively engage gear teeth in the housing. The turbine may include an offset cam that drives the shutter. The speed reduction achieved is the ratio of the difference in the number of gear teeth of the housing and the shutter to the number of gear teeth on the shutter. Expressed mathematically, this may be written as: (Housing Teeth-Shutter Teeth)/(Shutter Teeth).

Figure 2:
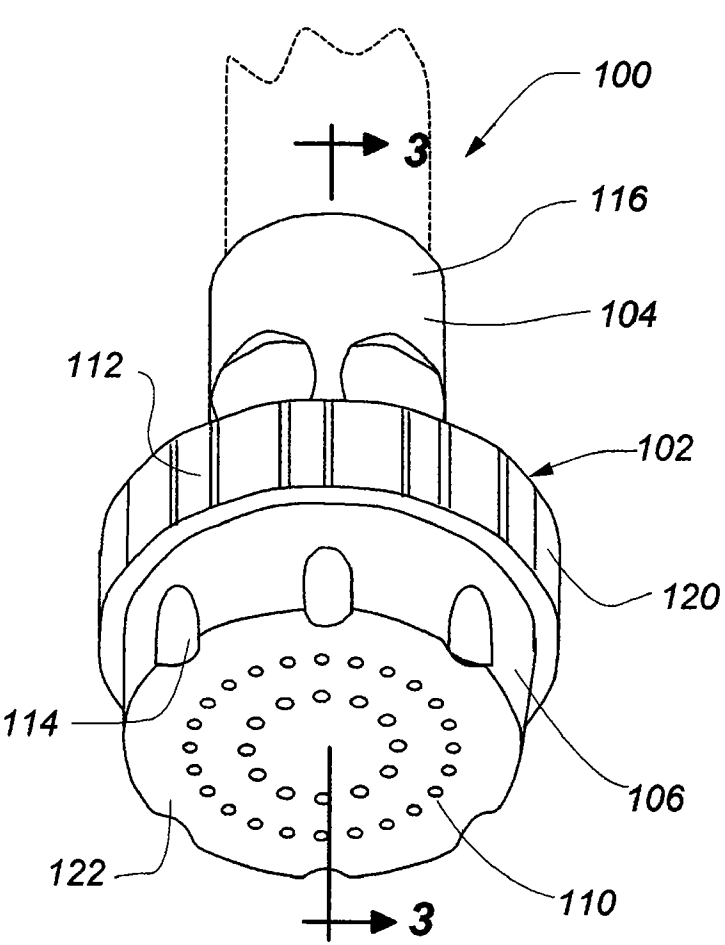
FIG. 2 depicts another perspective view of the showerhead shown in FIG. 1.
Figure 1:
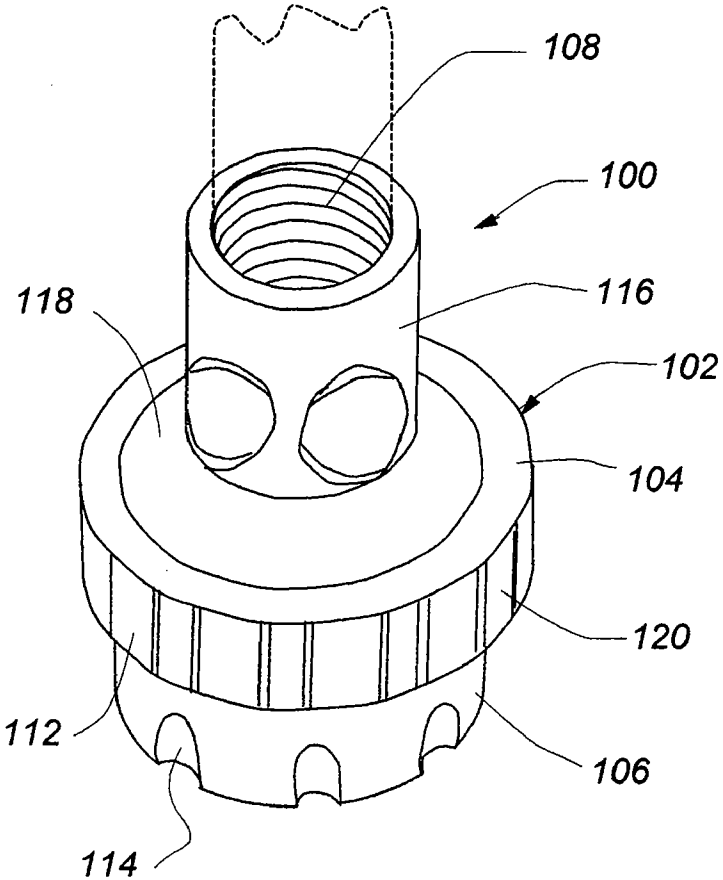
FIG. 1 depicts a perspective view of a first embodiment of a showerhead.

FIGS. 1-15 depict various views of a first embodiment of a showerhead 100. With reference to FIGS. 1 and 2, the showerhead 100 may include a housing 102. The housing 102 may be formed from upper and lower housing portions 104, 106. The upper housing portion 104 may include a fluid inlet for receiving fluid from a fluid source. The upper housing portion 104 may further include threads 108 proximate the fluid inlet for threadedly joining the showerhead 100 to a shower pipe, flexible arm, hose connector, arm assembly, or other device for conveying fluid, such as water, (i.e., a fluid source) to the showerhead 100. Although shown as threadedly joined to the fluid conveying device, the showerhead 100 may be attached to the fluid conveying device using any known connection method or combination of methods, including, but not limited to, press fitting, clamping, welding, and so on. The lower housing portion 106 may include one or more fluid outlets 110 in selective fluid communication with the fluid inlet. The fluid outlets 110 may be generally circular holes or any other suitably shaped hole or opening. A fluid, such as water, may be delivered from a fluid source to a user via the showerhead 100 through at least one of the fluid outlets 110.

The upper housing portion 104, the lower housing portion 106, or both portions may include user engagement features to facilitate joining the portions. For example, the upper and lower portions 104, 106 as shown in FIGS. 1 and 2 may each include recessed surfaces 112, 114 for providing a surface for a user to grip. In other embodiments, the upper housing portion 104, the lower housing portion 106, or both may incorporate other types of user engagement features, or combinations of features, such as raised protrusions, tabs, roughened surfaces, and so on, that may enhance a user's grip on the upper housing portion 104, the lower housing portion 106, or both portions for joining the portions, moving the showerhead 100 relative to a shower pipe or other device for conveying fluid to the showerhead, and/or selecting a showerhead operating mode.

Figure 3:
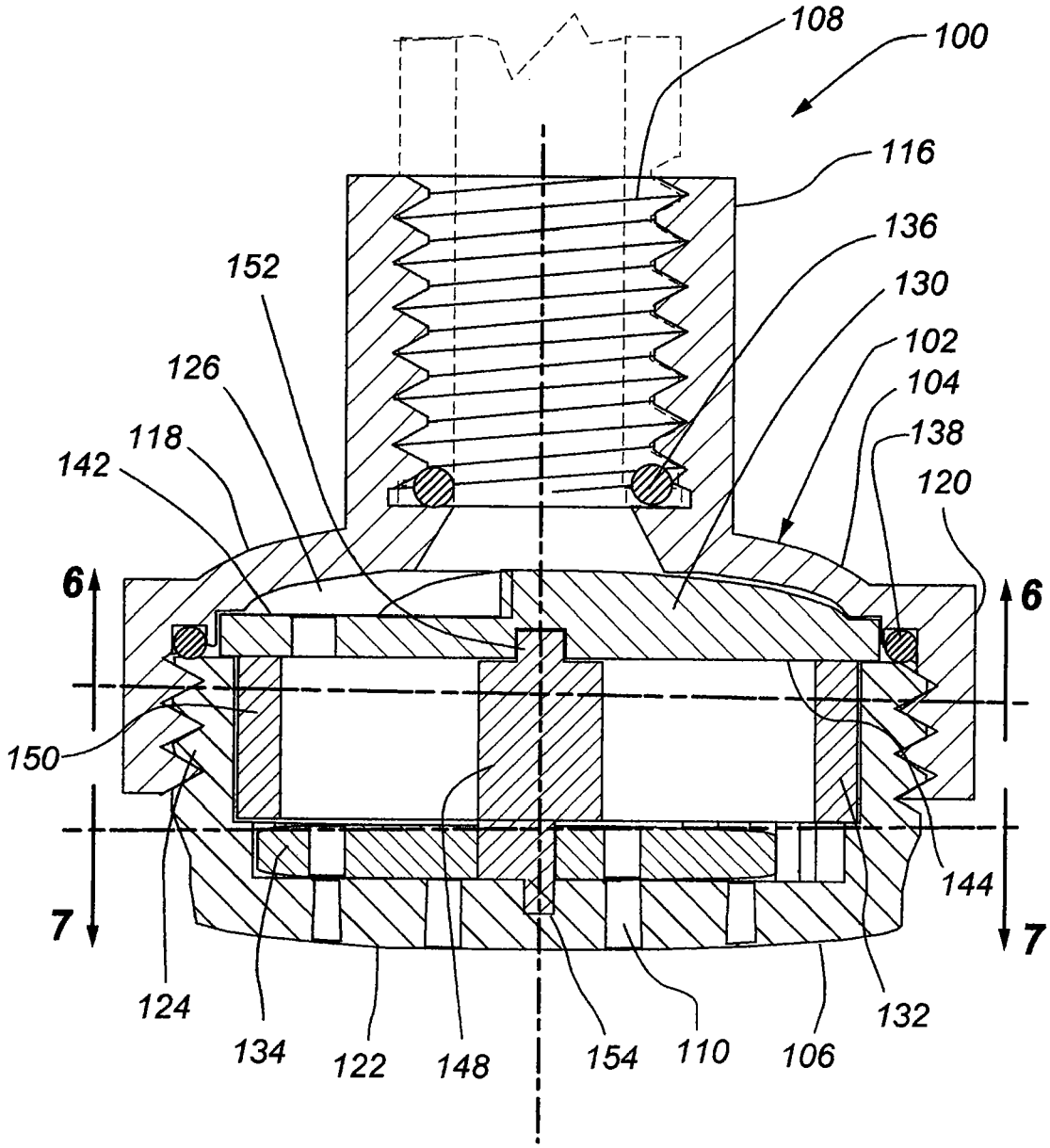
FIG. 3 depicts a cross-section view of the showerhead shown in FIG. 1, viewed along line 3-3 in FIG. 2.
Figure 4:
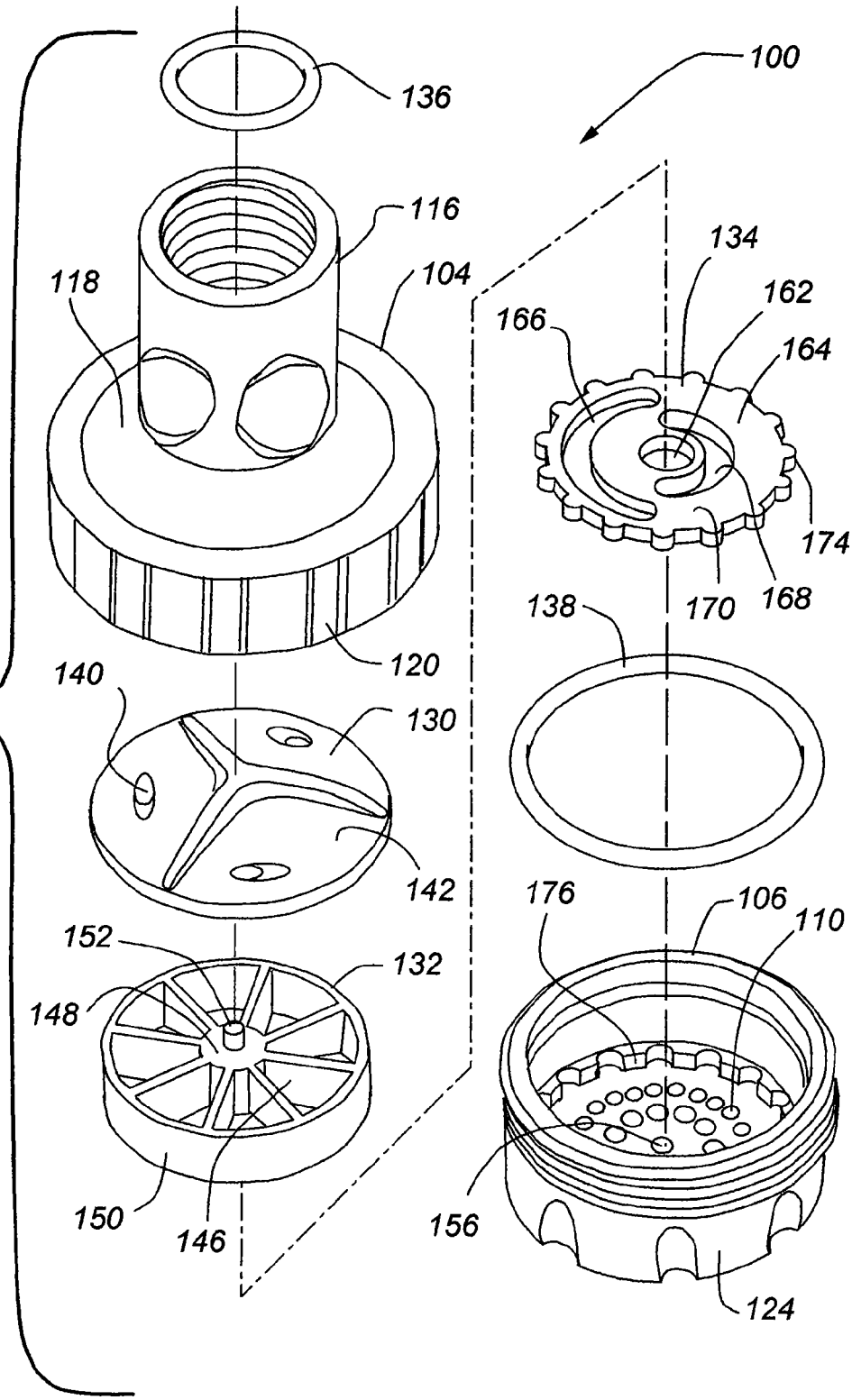
FIG. 4 depicts an exploded perspective view of the showerhead shown in FIG. 1.
Figure 5:
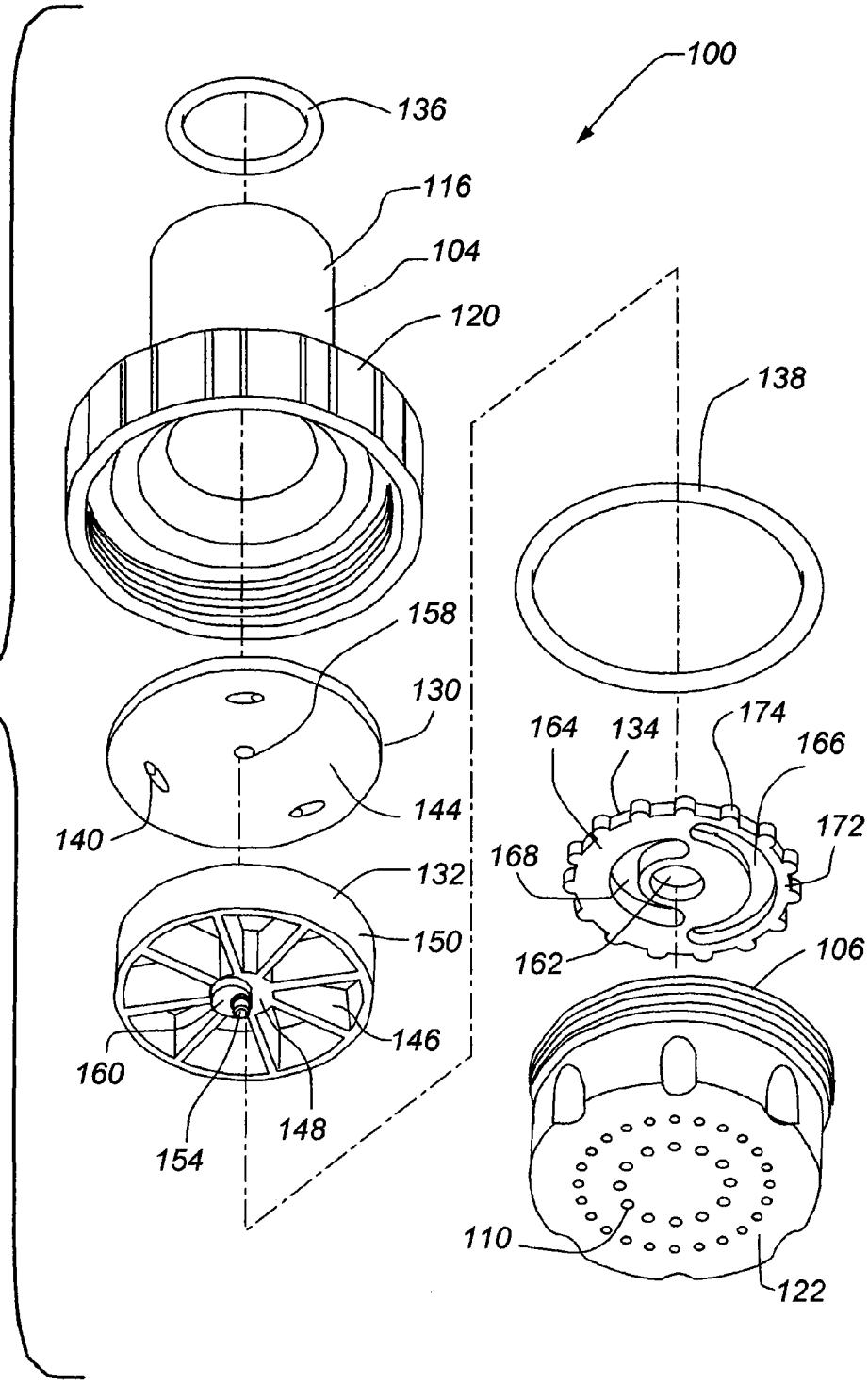
FIG. 5 depicts another exploded perspective view of the showerhead shown in FIG. 1.

Turning to FIGS. 3-5, the upper housing portion 104 may include a generally cylindrical housing shaft 116 defining a fluid passage. The fluid passage may be in fluid communication with the fluid inlet. A generally annular housing flange 118 may extend radially outward from a lower portion of the housing shaft 116. A generally circular upper housing sidewall 120 may extend generally downward from the housing flange 118. An inner surface of the upper housing sidewall 120 may include threads for joining the upper housing portion 104 to the lower housing portion 106. A flow restrictor (not shown), as known in the art, may be positioned in the fluid passage to limit fluid flow through the showerhead 100 from a fluidly connected fluid source.

The lower housing portion 106 may include a generally circular lower housing base 122. A generally circular lower housing sidewall 124 may extend upward from the lower housing base 122. An external surface of the lower housing sidewall 124 may include threads configured to engage the upper housing threads.

The upper and lower housing threads may be engaged to join the upper housing portion 104 to the lower housing portion 106. Although the upper housing threads are shown as internal threads and the lower housing threads are shown as external threads, the upper housing threads could be external and the lower housing threads could be internal. Further, the upper and lower housing portions 104, 106 may be joined by any known connection method, including, but not limited to, press fitting, clamping, welding, the aforementioned threading, and so on.

The upper housing portion 104 and the lower housing portion 106 may define a chamber or cavity 126. The chamber or cavity 126 may be defined by the upper housing flange 118, the lower housing sidewall 124, and the lower housing base 122. The chamber or cavity 126 may be generally cylindrical in shape or any other desired shape. The chamber or cavity 126 may be in fluid communication with the upper housing fluid passage and in selective fluid communication with the fluid outlets 110.

Although the shape and configuration of the upper and lower housing portions 104, 106 are described and shown with a certain particularity, the upper and lower housing portions 104, 106 may take the form of any desired shape to define the exterior and the interior of the housing 102. Further, the housing 102 may be formed from more or less than two housing portions. Yet further, although the housing 102 is shown as including one fluid inlet, one fluid passage, and one chamber or cavity, the housing may include or define more than one of any of these elements. For example, the housing 102 may define two fluid inlets, two fluid passages, and/or two chambers or cavities. The foregoing example is merely illustrative and is not intended to imply for the housing 102 any particular number or arrangement of fluid inlets, fluid passages, or chambers or cavities.

With continued reference to FIGS. 3-5, the showerhead 100 may further include a jet disk 130, a turbine 132, a shutter 134, and one or more sealing members 136, 138. The jet disk 130, the turbine 132, and the shutter 134 may be received within the cavity or chamber 126 defined by the housing 102. A fluid source seal member 136 may be positioned within the fluid inlet of the upper housing portion 104, and a housing seal member 138 may be positioned between the upper and lower housing portions 104, 106 proximate the area where these portions are joined.

The jet disk 130 may include a generally circular and planar body or any other suitably shaped body. The jet disk 130 may include one or more jet disk fluid jets or openings 140. Although three jets 140 are shown in FIGS. 4 and 5, the jet disk 130 may include more or less than three jets. Each jet 130 may extend from an upper to a lower surface 142, 144 of the jet disk 130, thus creating a path for fluid to flow from the jet disk's upper surface 142 to its lower surface 144. Further, the jets 140 may be angled relative to the jet disk's upper and lower surfaces 142, 144 to impart a directional flow to fluid passing through them. Such directional flow may cause the turbine 132 to rotate within the showerhead cavity 126. The jets 140 may also be shrouded, which may increase the fluid's flow speed. Alternative embodiments may vary the number of jets 140 employed and/or the shrouding configuration.

The turbine 132 may take the form of a generally hollow open-ended cylinder with blades 146 extending radially inward toward a central hub 148 from a generally circular turbine wall 150. The turbine wall 150, or at least a portion of the turbine wall 150, may be omitted in some embodiments. Further, the number of blades 146 may be more or less than the number depicted in the figures. The turbine 132 may include a first pin-shaped extrusion 152 extending generally upward from its upper side and a second pin-shaped extrusion 154 extending generally downward from its lower side. Each pin-shaped extrusion 152, 154 may be located along a central axis of the turbine 132. The lower pin-shaped extrusion 154 may be received in an opening 156 in the housing 102 and the upper pin-shaped extrusion 152 may be received in an opening 158 in the jet disk 130. The turbine 132 may rotate about its central axis (i.e., about the pin-shaped extrusions 152, 154). Alternatively, the turbine 132 may have an upper opening that receives a pin shaped extrusion extending from a lower side of the jet disk 130 and a lower opening that receives a pin shaped extrusion extending from the housing 102.

The turbine 132 may include an eccentric cam 160 on its lower side (i.e., the side facing the shutter 134). The shutter 134 may take the form of a generally circular and planar body or any other desired shape and may include an opening 162 along its central axis to receive the eccentric cam 160. The shutter 134 may thus spin about the central axis of the eccentric cam 160 as the turbine 132 rotates. The center of the eccentric cam 160 is off-center with respect to the center axis of the turbine 132 and housing 102. Thus, as the turbine 132 spins, the eccentric cam 160 moves the center of the shutter 134 in a generally circular path around the center axis of the turbine 132 and the housing 102. As the center of the shutter 134 moves in this generally circular path, the portion of its perimeter that engages or otherwise contacts the lower housing portion's side wall 124 changes as shown, for example, in FIGS. 12-15.

The shutter body 164 may include one or more fluid openings 166, 168 through its thickness for water to pass from the upper side 170 to the lower side 172 of the shutter 134. The shutter fluid openings 166, 168 may be selectively aligned with at least some of the outlets 110 in the housing 102. When aligned, water or other fluid may flow from the housing chamber or cavity 126 and out of the outlets 110 aligned with the shutter fluid openings 166, 168. The shutter 134 may include an engagement feature 174, which may take the form of gear teeth or the like. The gear teeth may be, although not necessarily, uniformly distributed around the shutter body's periphery.

The housing 102 may include a housing engagement feature 176 to engage the shutter's engagement feature. The housing engagement feature may be engaging teeth complementary to the shutter's gear teeth. These may be, but not necessarily, equally spaced around the interior periphery of the lower housing portion 106. As shown, for example, in FIG. 7, the shutter 134 may include fifteen gear teeth, and the housing 102 may include sixteen housing teeth. Other embodiments may use a different number of gear teeth for the shutter 134 and/or housing 102. At least some of the shutter's gear teeth may engage the housing's gear teeth. Further, as the turbine 132 rotates, the gear teeth of the shutter 134 that engage the gear teeth of the housing 102 may change.

Returning to FIGS. 3-5, the fluid source seal member 136 may form a fluid seal between the showerhead 100 and a fluid source joined to the showerhead 100. More particularly, the fluid source seal member 136 may substantially limit or otherwise prevent fluid leakage from the showerhead 100 along the threaded joint that joins that fluid source to the showerhead 100. The housing seal member 138 may form a fluid seal between the upper and lower housing portions 104, 106 to substantially limit or otherwise prevent fluid leakage from the showerhead 100 along the threaded joint that joins the upper housing portion 104 to the lower housing portion 106. The fluid source and housing seal members 136, 138 may take the form of O-rings or any other suitable element that provides a fluid seal between two or more members or components and may be composed of an elastomeric material, such as rubber, or any other known fluid sealant material.

Figure 6:
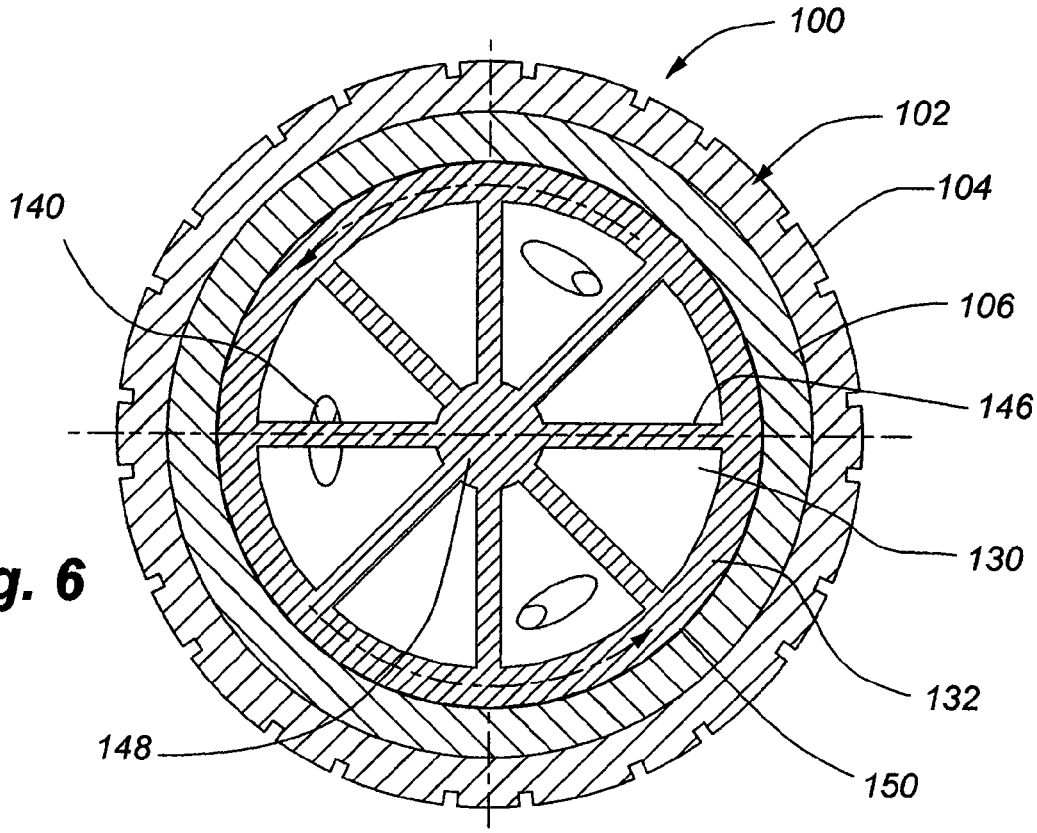
FIG. 6 depicts another cross-section view of the showerhead shown in FIG. 1, viewed along line 6-6 in FIG. 3.
Figure 7:
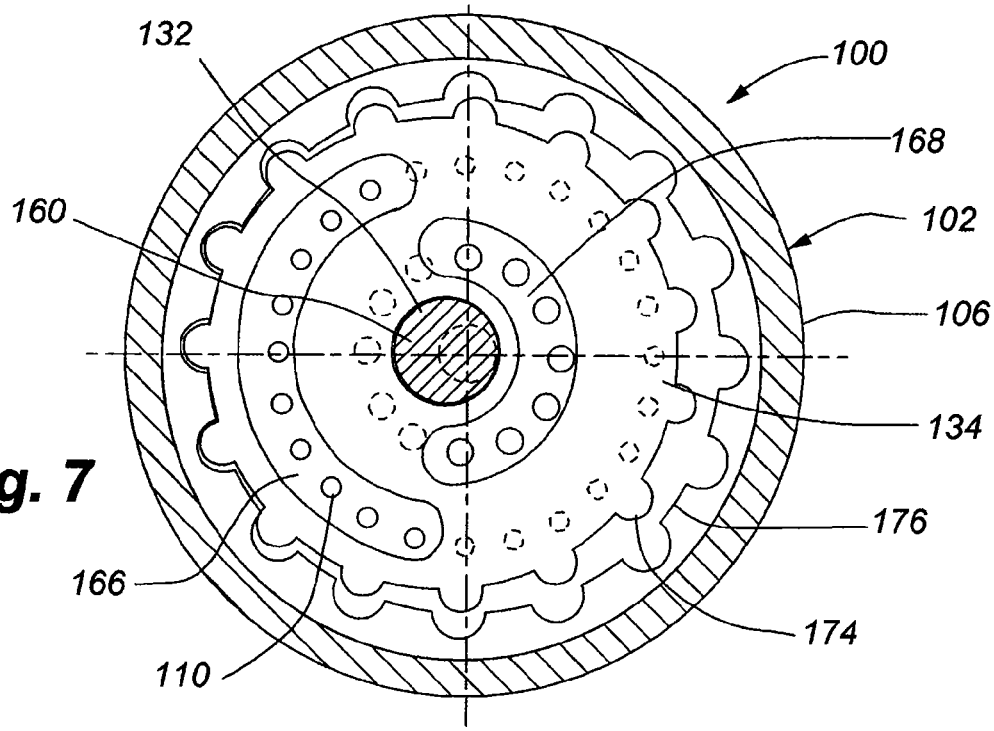
FIG. 7 depicts yet another cross-section view of the showerhead shown in FIG. 1, viewed along line 7-7 in FIG. 3.

Operation of the showerhead 100 will now be described with reference to FIGS. 3, 6 and 7. Water or other fluid may flow through the fluid inlet from the fluid source to the jet disk 130. As water or other fluid passes through the jets 140, it impacts one or more blades 146 of the turbine 132, which is situated within the housing 102 between the shutter 134 and the jet disk 130. Water impacting the turbine blades 146 imparts rotational motion to the turbine 132. As viewed from the side of the turbine 132 facing the shutter 134 as shown, for example, in FIG. 6, the turbine 132 may rotate in a clockwise fashion. Alternative embodiments may cause the turbine 132 to rotate in a counterclockwise fashion. After impacting the turbine blades 146, the water hits the upper side 170 of the shutter 134.

As the turbine 132 rotates from water impacting its blades 146, the turbine 132 causes the center of the shutter 134 to move in a generally circular motion via the aforementioned connection between the shutter 134 and the turbine's eccentric cam 160. This meshes at least some of the external teeth of the shutter 134 with some of the internal teeth of the housing 102 resulting in rotational movement of the shutter 134 relative to the turbine 132. Additionally, the teeth of the shutter 134 and housing 102 disengage at a side of the shutter 134 approximately opposite the point of engagement as shown, for example, in FIG. 7 and FIGS. 12-15.

Since the shutter 134 has one less tooth than the housing 102 and tooth disengagement between the shutter 134 and the housing 102 is made possible by motion of the center of the shutter 134 in a generally circular path around the central axis of the turbine 132, each complete revolution of the turbine 132 results in a one tooth displacement of the shutter 134 in relation to the housing 102. This displacement is in the opposite direction of the rotation of the turbine 132. For example, if the turbine 132 is rotating in a clockwise direction, the one tooth displacement of the shutter 134 relative to the housing 102 will be in a counter-clockwise direction and vice versa. Thus, selective engagement of the shutter teeth with the housing teeth functions as a speed reduction mechanism because the shutter 134 rotates 1/15th as quickly as it would absent this engagement.

The speed reduction achieved (i.e., how fast the shutter 134 rotates relative to how fast the turbine 132 rotates) is determined by the ratio of the difference between number of engagement features 174, 176 of the housing 102 and the shutter 134 to the number of engagement features 174 on the shutter 134. For the showerhead depicted in FIGS. 1-15, a speed reduction of $1/15^{th}$ occurs since the housing 102 has sixteen gear teeth and the shutter 134 has fifteen gear teeth. That is, the shutter 134 rotates at $1/15^{th}$ the rotational speed of the turbine 132.

Figure 7A:
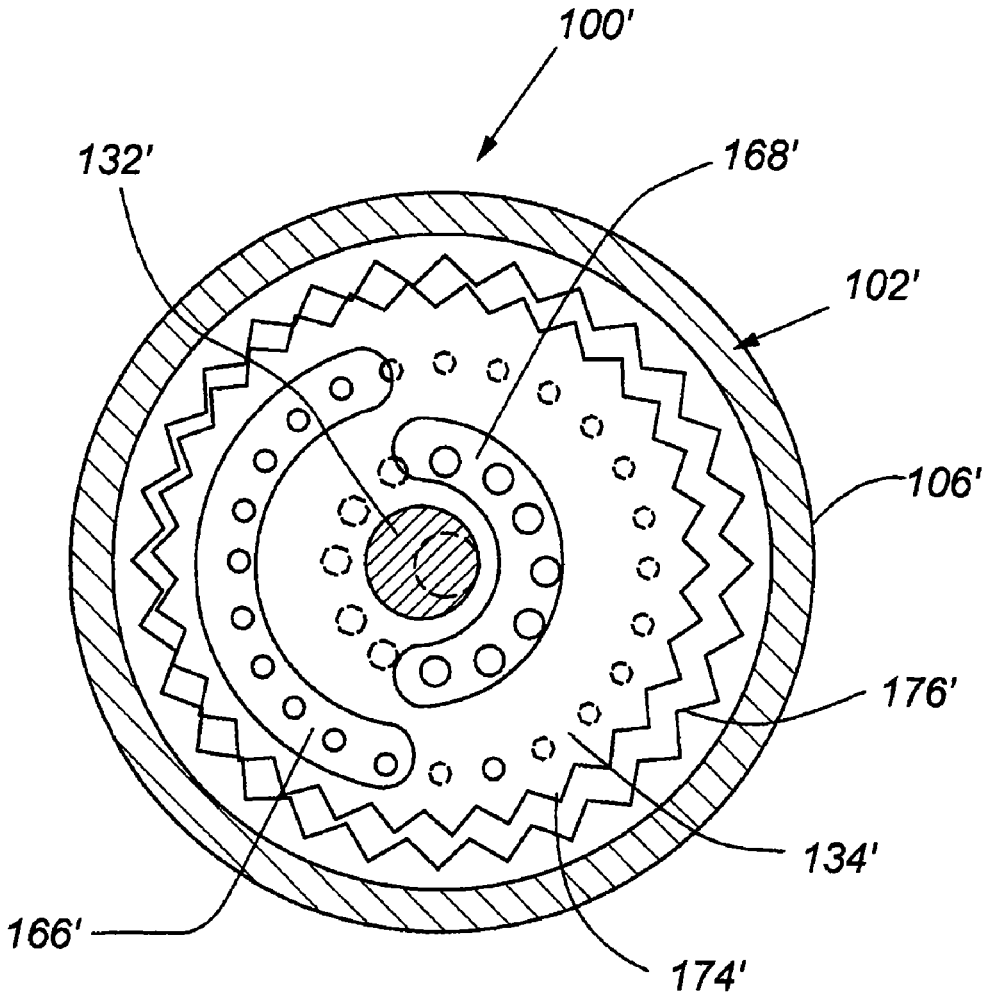
FIG. 7A depicts a cross-section view of an alternate embodiment, similar to the view shown in the embodiment of FIG. 7, depicting a precessinq shutter with more engagement features on the shutter than on the housing.

In other embodiments, the shutter 134 may have 30 gear teeth and the housing 102 may have 31 gear teeth. This causes the shutter 134 to turn in the opposite direction of the turbine 132 by $1/30^{th}$ of the rotational rate of the turbine 132. In other words, the shutter 134 rotates approximately $1/30^{th}$ about its central axis each time the turbine 132 completes one revolution, and the shutter 134 rotates in the opposite direction of the turbine 132. Accordingly, the shutter 134 completes a complete revolution in the opposite direction of the turbine 132 each time the turbine 132 completes 30 revolutions. In yet other embodiments, the shutter 134 may have more engagement teeth than the housing 102, which causes the shutter 134 to rotate in the same direction as the turbine 132, albeit at a slower rate. For example, as shown in FIG. 7A, some embodiments may use a shutter 134' with thirty engagement features 174' (e.g., gear teeth) and a housing 120' with twenty-eight engagement features 176', (e.g., housing teeth). This causes the shutter 134' to precess, i.e., turn in the same direction as the turbine 132', at a rate of $1/15^{th}$ the speed of the turbine 132'. Other embodiments may employ a shutter 134 and a housing 102 with more or fewer teeth to achieve a desired speed reduction and direction of rotation of the shutter 134 relative to the rotational speed and direction of rotation of the turbine 132.

Referring to FIGS. 8-12, as the shutter 134 rotates inside the housing 102, one or more shutter fluid openings 166, 168 in the shutter 134 pass over rows of outlets 110 in the housing 102. In this manner, water may temporarily flow through the unobstructed outlets 110 located under the shutter fluid openings 166, 168. Thus, as the shutter 134 rotates, water flow through the outlets 110 is periodically interrupted as the solid portion of the shutter 134 temporarily obstructs water flow through outlets 110 located under the solid portion of the shutter 134 as depicted, for example, in FIGS. 8-12. This creates a pulsating flow of water from the showerhead 100. The period of the pulsating flow is determined, in part, by the rotational speed of the shutter 134 as further explained below.

Figure 8:
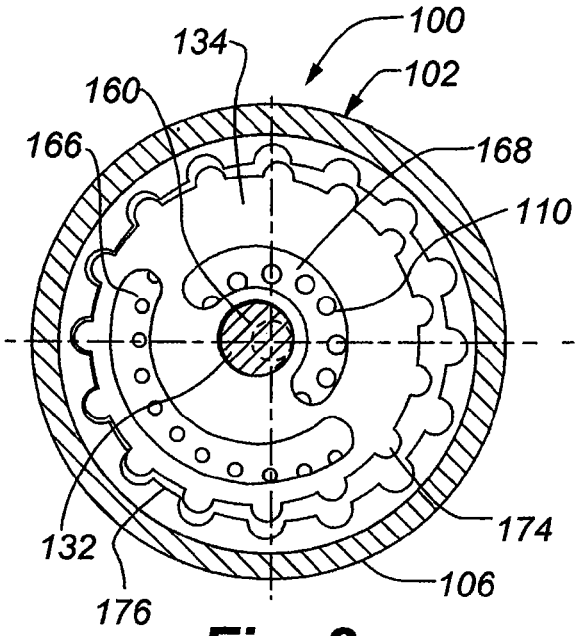
FIG. 8 depicts still yet another cross-section view of the showerhead shown in FIG. 1, showing a view similar to the view shown in FIG. 7.
Figure 9:
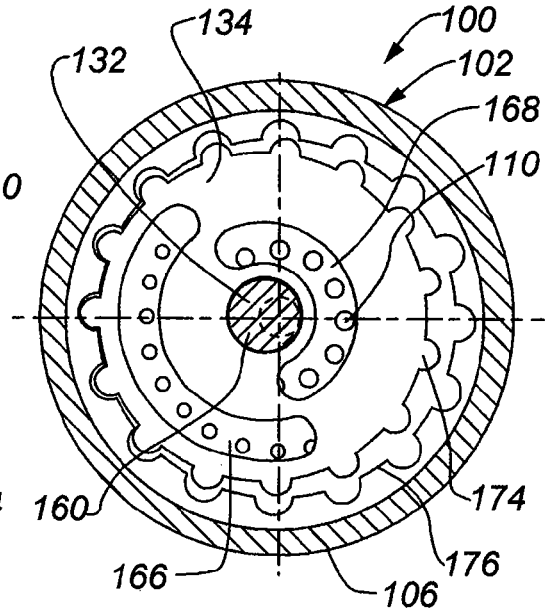
FIG. 9 depicts a cross-section view of the showerhead shown in FIG. 1 similar to the view shown in FIG. 8, showing the position of the shutter openings relative to the showerhead outlets after the turbine has moved one complete revolution from the position shown in FIG. 8.
Figure 10:
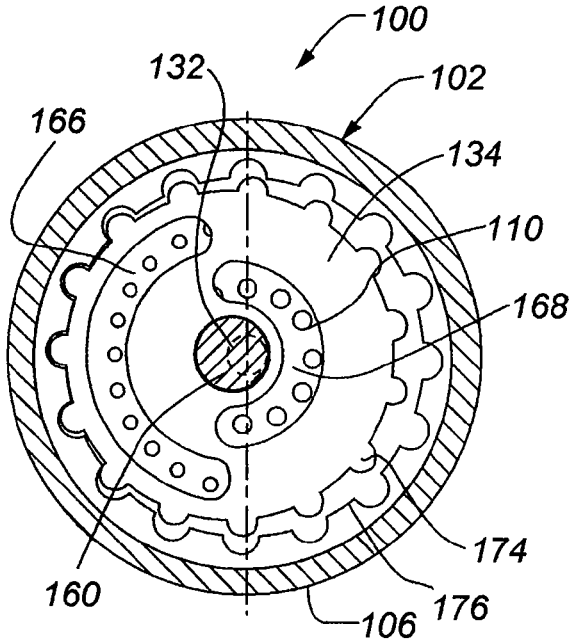
FIG. 10 depicts a cross-section view of the showerhead shown in FIG. 1 similar to the view shown in FIG. 8, showing the position of the shutter openings relative to the showerhead outlets after the turbine has moved two complete revolutions from the position shown in FIG. 8.
Figure 11:
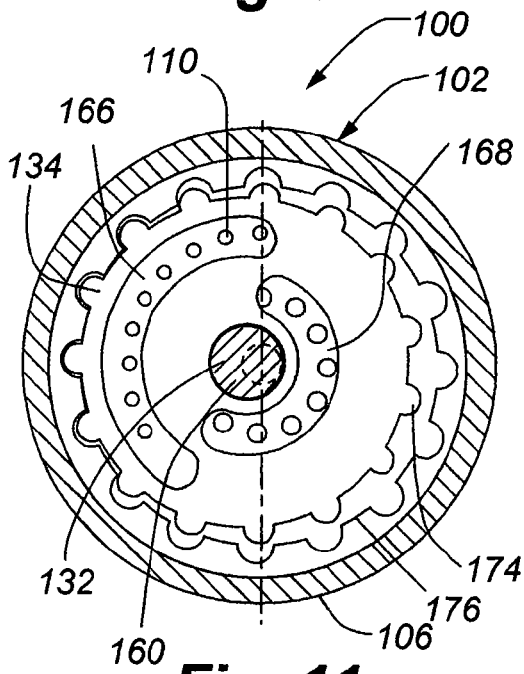
FIG. 11 depicts a cross-section view of the showerhead shown in FIG. 1 similar to the view shown in FIG. 8, showing the position of the shutter openings relative to the showerhead outlets after the turbine has moved three complete revolutions from the position shown in FIG. 8.
Figure 12:
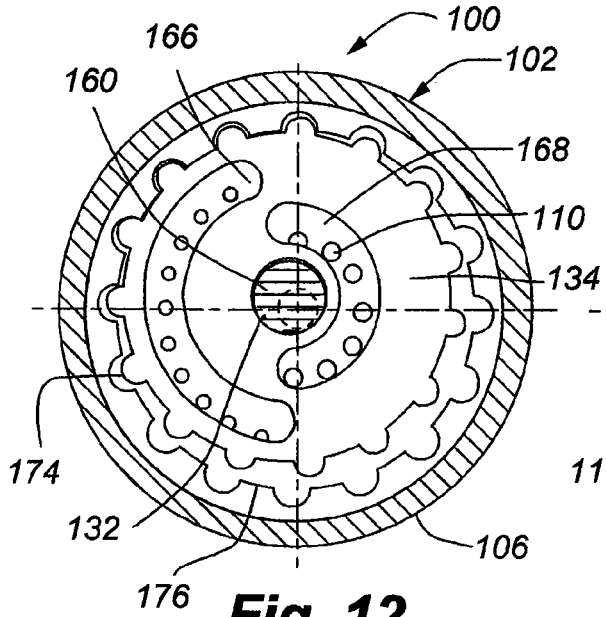
FIG. 12 depicts yet a further cross-section view of the showerhead shown in FIG. 1, showing a view similar to the view shown in FIG. 7 and showing the cam in a first position.
Figure 13:
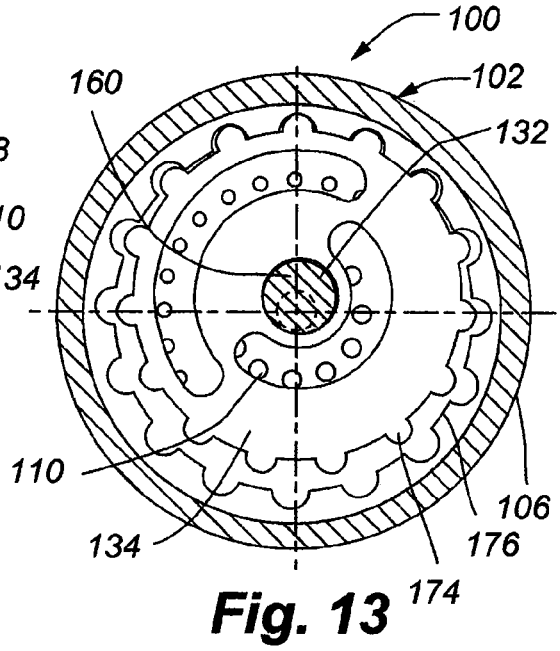
FIG. 13 depicts a cross-section view of the showerhead shown in FIG. 1 similar to the view shown in FIG. 12, showing the cam in a second position and the relationship of the perimeter of the shutter to the housing when the cam is in the second position.
Figure 14:
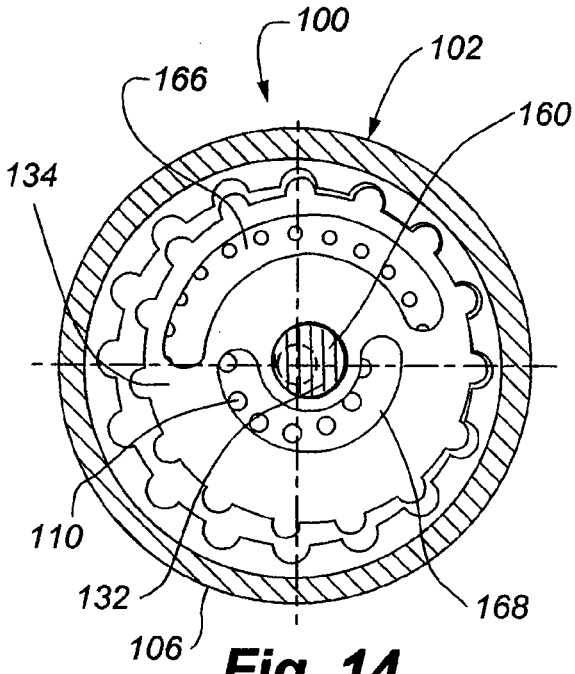
FIG. 14 depicts a cross-section view of the showerhead shown in FIG. 1 similar to the view shown in FIG. 12, showing the cam in a third position and the relationship of the perimeter of the shutter to the housing when the cam is in the third position.
Figure 15:
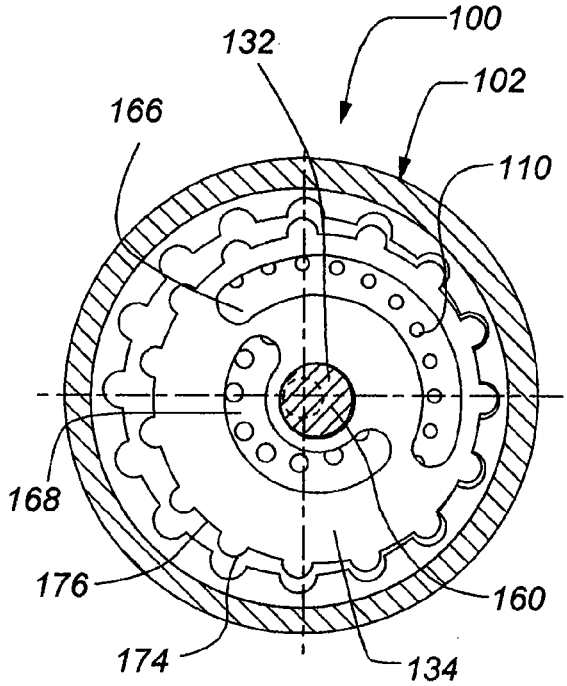
FIG. 15 depicts a cross-section view of the showerhead shown in FIG. 1 similar to the view shown in FIG. 12, showing the cam in a fourth position and the relationship of the perimeter of the shutter to the housing when the cam is in the fourth position.
Figure 17:
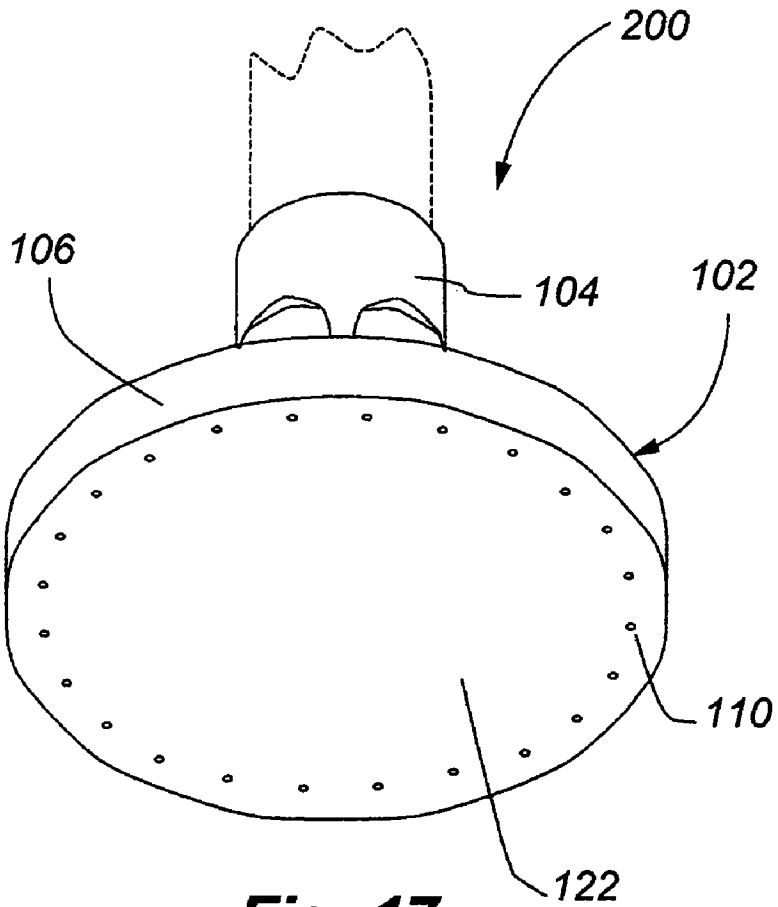
FIG. 17 depicts another perspective view of the showerhead shown in FIG. 16.
Figure 16:
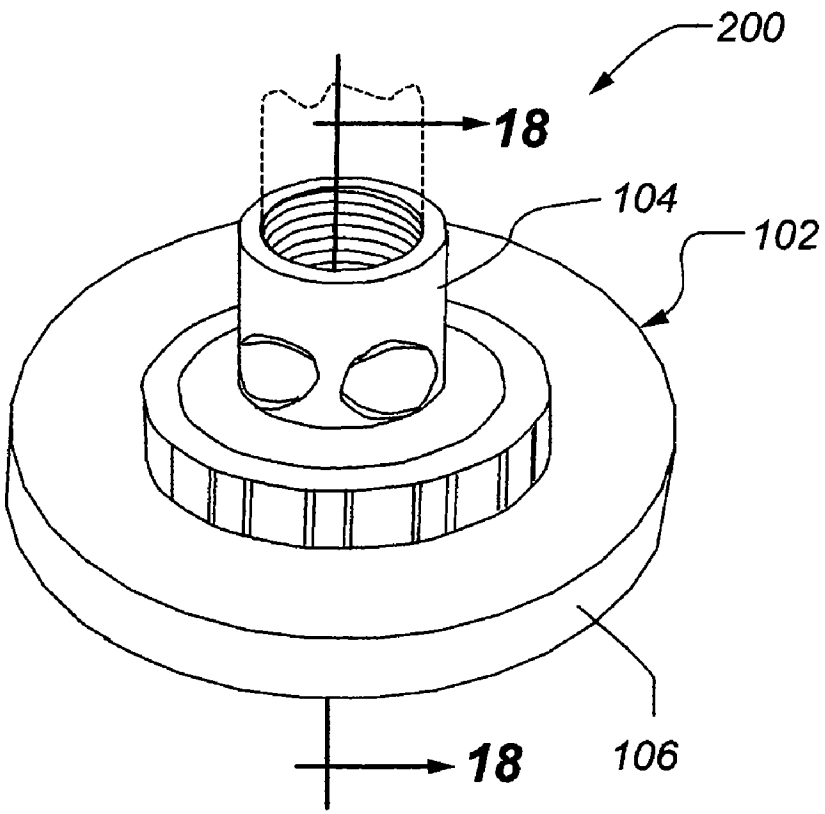
FIG. 16 depicts a perspective view of a second embodiment of a showerhead.

FIG. 9 generally depicts the shutter 134 rotated clockwise within the housing 102 from the relative position occupied in FIG. 8 after the turbine 132 has completed one complete revolution in a counter-clockwise direction. FIG. 10 generally depicts the shutter 134 rotated clockwise within the housing 102 from the relative position occupied in FIG. 8 after the turbine 132 has completed two complete revolutions in a counter-clockwise direction. FIG. 11 generally depicts the shutter 134 rotated clockwise within the housing 102 from the relative position occupied in FIG. 8 after the turbine 132 has completed three complete revolutions in a counter-clockwise direction.

With reference to FIGS. 8-12, the shutter 134 may have inner and outer fluid openings 166, 168 that each extend about half way around the shutter 134. The inner and outer fluid openings 166, 168 may generally be formed on opposing halves of the shutter 134. The housing 102 also may include an inner and outer circular row of outlets 110. The inner fluid opening 168 of the shutter may overlap at least part of the inner circular row of outlets 110, while the outer fluid opening 166 may overlap at least part of the outer circular row of outlets 110. When the shutter fluid openings 166, 168 are positioned over certain outlets 110, water flows through these unobstructed outlets 110 to exit the showerhead 100. When an outlet 110 is not aligned with at least one of the shutter fluid openings 166, 168, water flow is blocked through that outlet 110. Thus, as the shutter 134 rotates, water flow through the outlets 110 may be interrupted in a sequence. This may, for example, produce a relatively low speed, periodic interruption of water flow through each row of outlets 110.

As previously discussed, for the embodiment depicted in FIGS. 1-15, there are 15 gear teeth on the shutter 134 and 16 gear teeth in the housing 102 causing the shutter 134 to rotate in a direction opposite the turbine 132 at a rate $1/15^{th}$ that of the turbine 132. The period of the pulsating flow of water through an outlet 110 is a direct multiple of the speed reduction times the turbine speed. Thus, if water flow through the showerhead 100 causes the turbine 132 to spin at 60 revolutions per second, the shutter 134 will rotate at a rate of 4 revolutions per second. This results in a period of the pulsating flow through an outlet 110 of about 0.25 seconds, which may simulate the feel of a hand massage. As yet another example, if the turbine 132 rotates at 50 revolutions per minute and the speed reduction is $1/10^{th}$, the shutter 134 will rotate at a rate of five revolutions per minute. This results in a period of the pulsating flow through an outlet 110 of about 0.20 seconds. The foregoing examples are merely illustrative and are not intended to imply or require a particular speed reduction, turbine speed, or pulse time.

The aforementioned pulse time represents the period of time for one complete cycle of flow through an outlet 110. In other words, the time it takes for water to start flowing through an outlet 110, stop flowing through the outlet 110, and then start flowing again through the outlet 110. The ratio of the amount of time that water flows and does not flow through an outlet during a single cycle is a function of the length of the shutter fluid opening. As the length of the shutter fluid opening increases, the ratio of the time water flows through the associated outlet 110 to the time it does not flow through the outlet 110 increases. For example, if a shutter fluid opening has a length that extends approximately one-half of the circumference of the shutter 134 as shown, for example, in FIGS. 12-15, the ratio of the time water flows through an outlet 110 to not flowing through the outlet 110 will be approximately 1:1. As another example, if a shutter fluid opening has a length that extends approximately one-quarter of the circumference of the shutter 134, the ratio of the time water flows through an outlet 110 to not flowing through the outlet 110 will be approximately 1:3. The foregoing examples are merely illustrative and are not intended to imply any particular length or ratio of flow time during a single cycle for a showerhead.

FIGS. 16-25 depict various views of a second embodiment of a showerhead 200. The second showerhead 200 is similar in structure and operation to the first showerhead 100 and like numbers for the second showerhead 200 may be used for similar or like elements of the first showerhead 100. Like the first showerhead 100, the second showerhead 200 may include a turbine 132, a jet disk 130, a shutter 134 and a housing 102. In this particular embodiment, the shutter 134 may include one fluid opening 202 that extends about two-thirds the way around the shutter 134, as shown, for example, in FIGS. 19-20. The showerhead 200 may also include one or more seal members 136, 138, such as a fluid inlet seal member 136 and housing seal member 138 as shown, for example, in FIGS. 18-20. The fluid inlet seal member 136 and the housing seal member 138 may be similar to the corresponding seal members 136, 138 described for the first showerhead 100.

Figure 18:
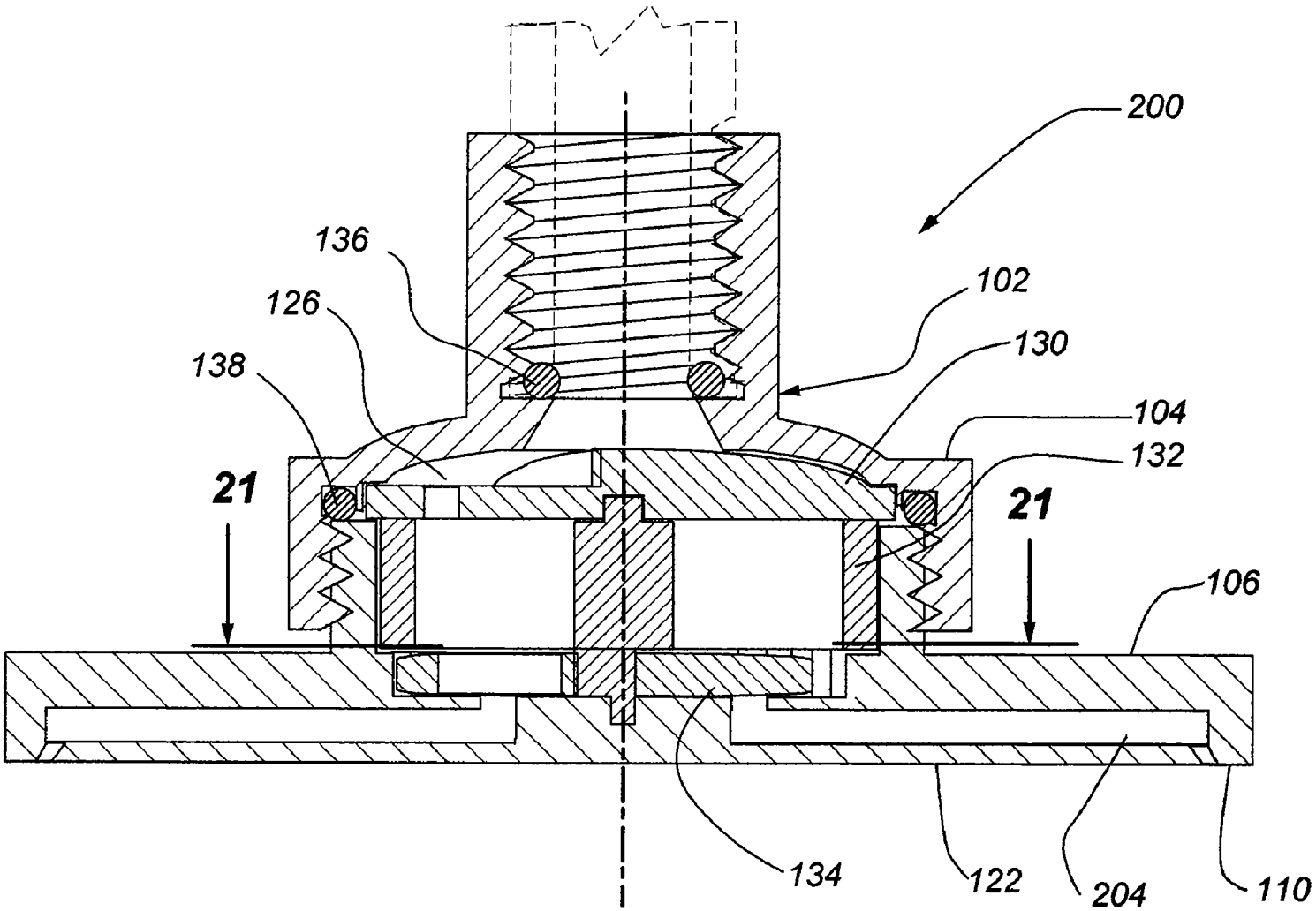
FIG. 18 depicts a cross-section view of the showerhead shown in FIG. 16, viewed along line 18-18 in FIG. 16.
Figure 19:
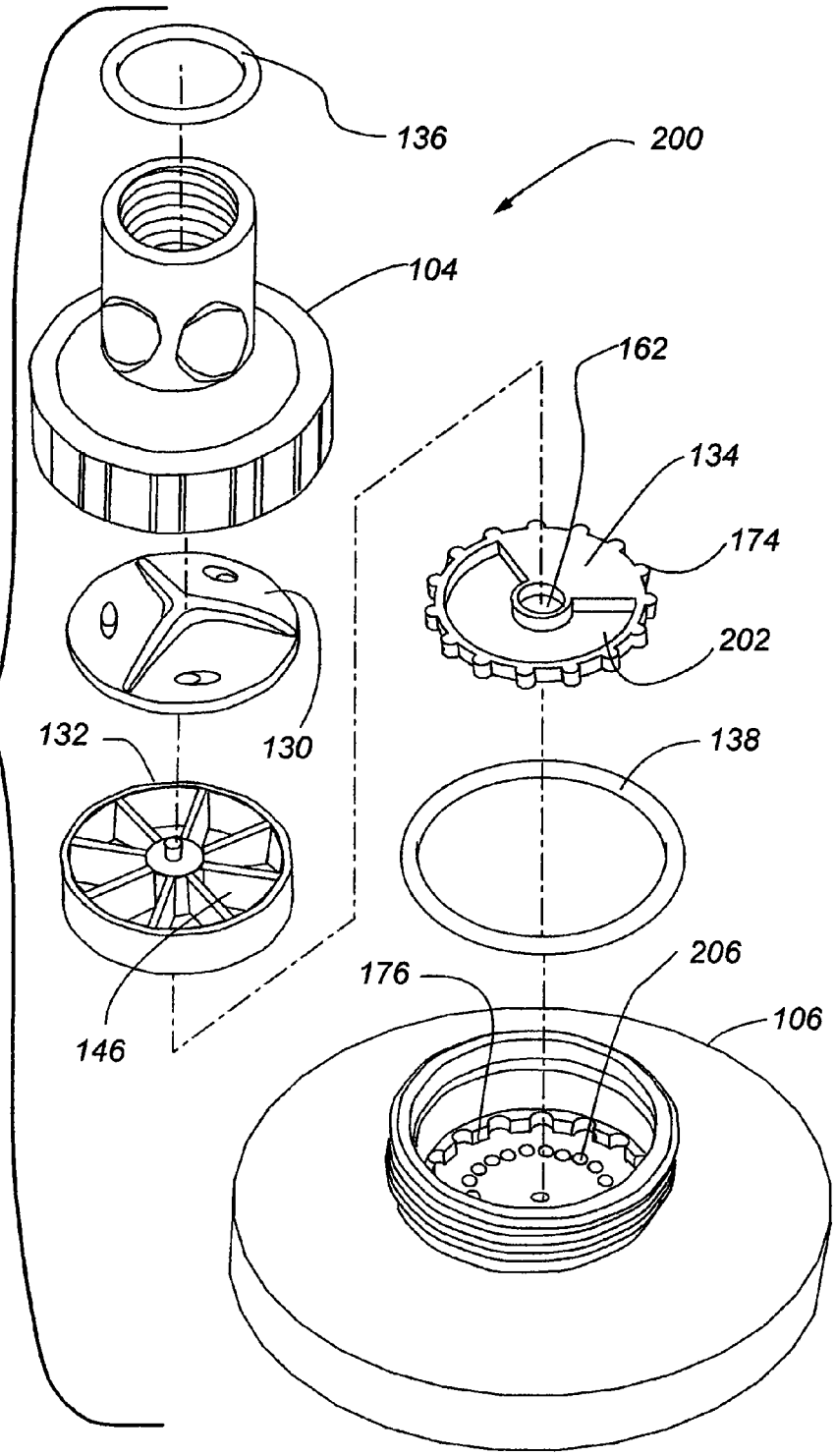
FIG. 19 depicts an exploded perspective view of the showerhead shown in FIG. 16.
Figure 20:
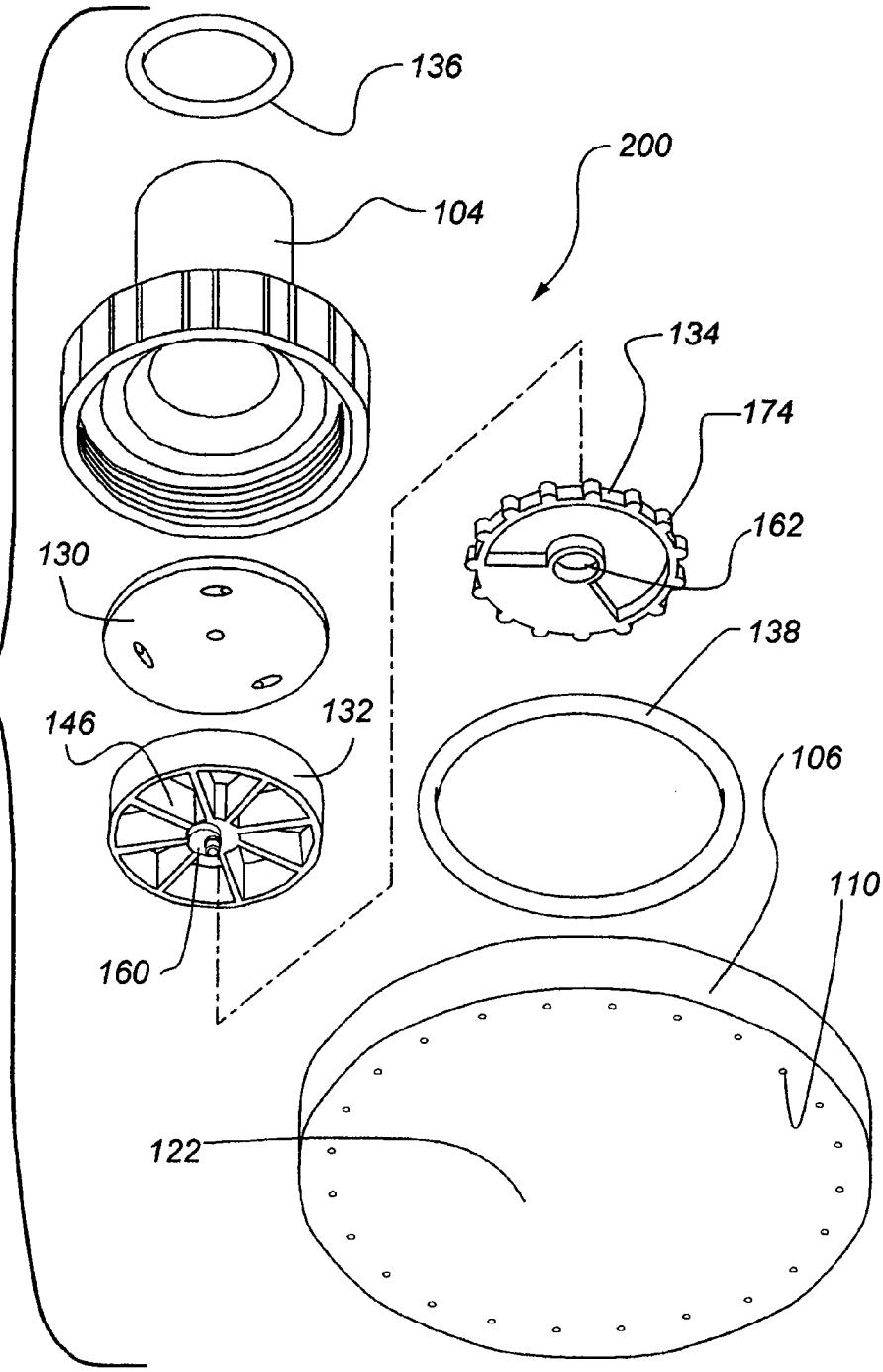
FIG. 20 depicts another exploded perspective view of the showerhead shown in FIG. 16.

Like the first embodiment, the housing 102 for the second showerhead 200 may include upper and lower housing portions 104, 106 threadedly joined as shown, for example, in FIG. 18, or joined by any other known connection method or combination thereof. Also like the housing 102 for the first showerhead 100, the housing 102 for the second showerhead 200, although shown as having a particular shape in the figures, may be formed into any desired shape and may be formed from any desired number of portions or components. The housing 102 may include one row of outlets or nozzles 110 as shown in FIG. 20, which may be fluidly connected the housing chamber or cavity 126 via fluid passages or conduits 204 defined in a base 122 of the lower housing portion 106 as shown, for example, in FIGS. 18 and 19. Each fluid passage 204, in turn, may include a fluid passage opening 206 defined in an upper surface of the base 122 for fluidly joining the fluid passage to the housing chamber or cavity 126. For a given sized turbine 132 and/or chamber 126, the fluid conduits allow for the use of a larger showerhead 200 to create a larger diameter spray pattern from the showerhead 200.

Like the shutter 134 for the first showerhead 100, the shutter 134 for the second showerhead 200 may include a generally circular and planar (or any other shaped) body including at least one shutter fluid opening 202. Also like the shutter 134 for the first showerhead 100, the shutter 134 for the second showerhead 200 may include a cam opening 162 along its central axis for receiving an eccentric cam 160 formed on the turbine 132. The shutter 134 may thus spin or rotate about the central axis of the eccentric cam 160 as the turbine 132 rotates in a manner similar to the shutter 134 for the first showerhead 100. As the turbine 132 spins, the motion of the eccentric cam 160 causes the shutter 134 to rotate about the center of the eccentric cam 160 such that the portions of the shutter's periphery that contacts the housing 102 changes as described in more detail above for the first showerhead 100.

Figure 21:
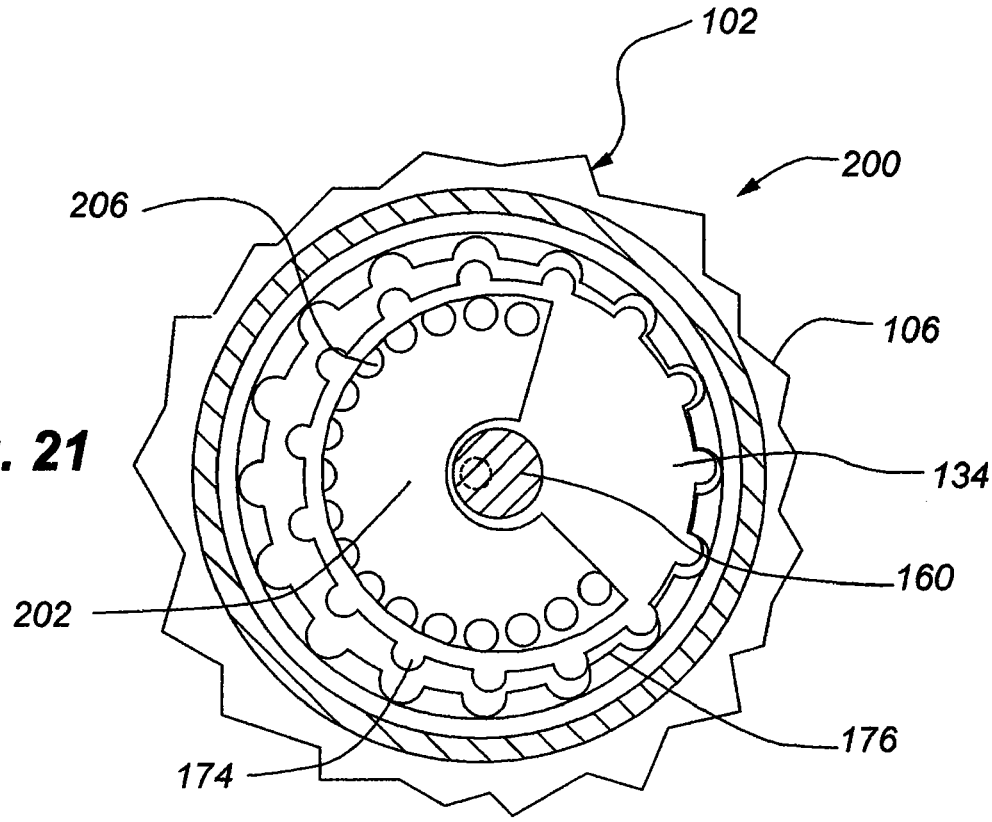
FIG. 21 depicts another cross-section view of the showerhead shown in FIG. 1, viewed along line 21-21 in FIG. 18.
Figure 22:
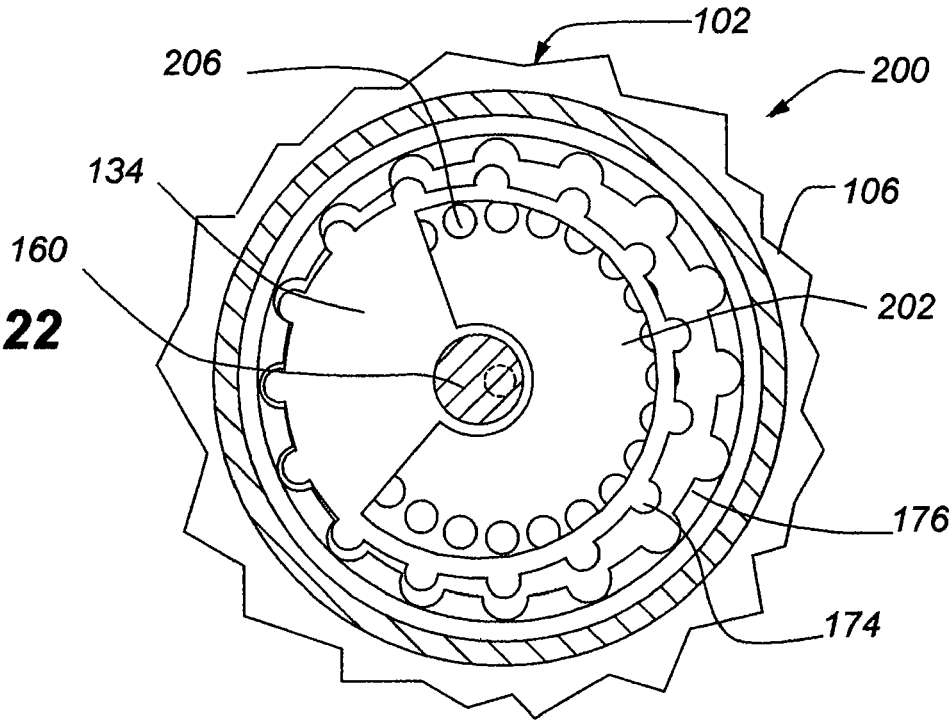
FIG. 22 depicts a cross-section view of the showerhead shown in FIG. 16 similar to the view shown in FIG. 21, showing the position of the shutter opening relative to the housing after rotation of the shutter within the housing.
Figure 25:
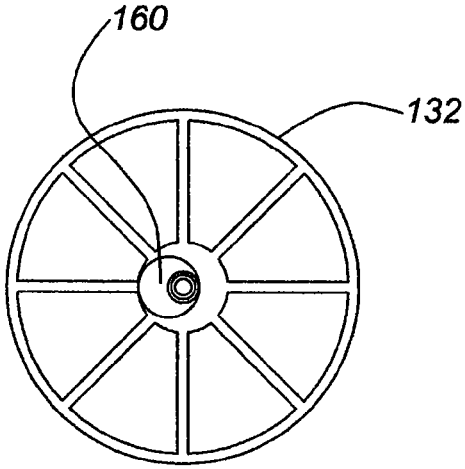
FIG. 25 depicts a bottom view of the turbine for the showerhead shown in FIG. 16.
Figure 24:
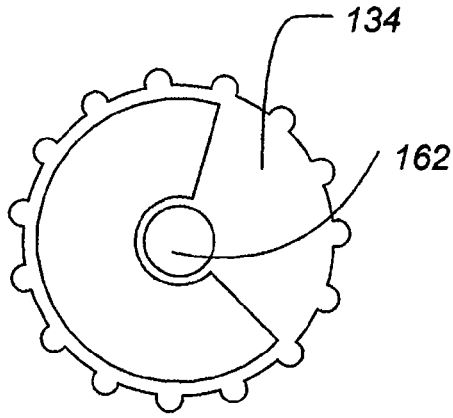
FIG. 24 depicts a top view of the shutter for the showerhead shown in FIG. 16.
Figure 23:
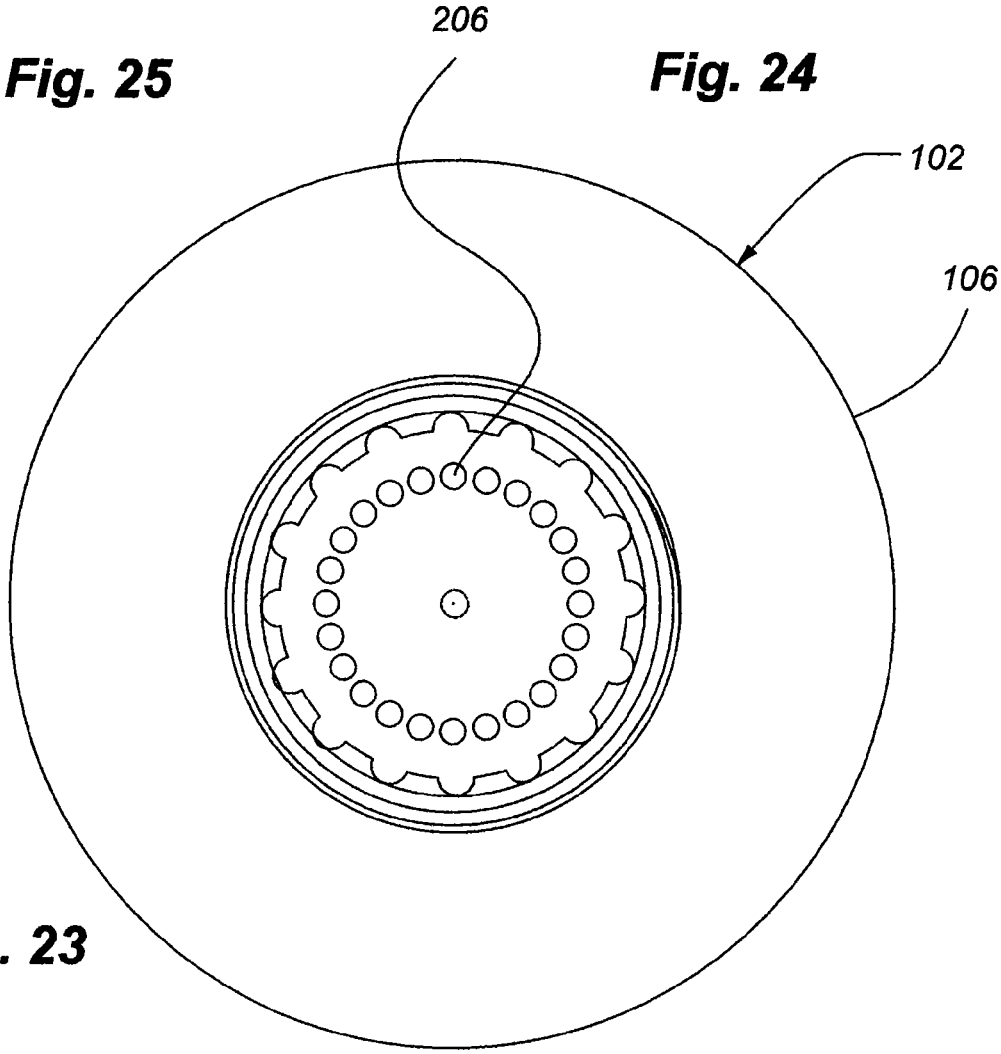
FIG. 23 depicts a top view of the housing for the showerhead shown in FIG. 25.

The shutter 134 and housing 102 may each include one or more gear teeth, as described above. For example, and as illustrated in FIGS. 21 and 22, the shutter 134 may have 15 gear teeth and the housing may have 16 gear teeth that engage the shutter teeth. Accordingly, the shutter 134 rotates inside the housing 102 in an opposite direction with respect to the turbine 132 at a rate $1/15^{th}$ the speed of the turbine 132. FIG. 22 generally depicts the shutter 134 rotated clockwise within the housing 102 from its position in FIG. 21.

As depicted in FIGS. 21 and 22, as the shutter 134 rotates, the flow of water through the fluid passage openings 206, and thus the outlet 110 in fluid communication with a respective fluid passage opening 206, is interrupted as the solid portion of the shutter 134 passes over a fluid passage opening 206. When the shutter fluid opening 202 is over a fluid passage opening 206, water flows through the associated fluid passage 204 and exits the showerhead 200 through the outlet 110 associated with the fluid passage 204. When a fluid passage opening 206 is not aligned with the shutter fluid opening 202, water flow ceases through the outlet 110 in fluid communication with the fluid passage opening 206. Thus, as the shutter 134 rotates, water flow through the outlets 110 may be interrupted in a sequence. This may, for example, produce a relatively low speed, periodic interruption of water flow through each outlet 110. Other embodiments may employ more or fewer rows of outlets 110 in the housing 102 and may employ more or fewer shutter fluid openings 202 to create a variety of low speed pulsating water flow patterns. As an example, the shutter fluid openings 202 may be radially aligned with one another to produce a spray pattern. As another example, the outlets 110 may be grouped within one or more sectors on the housing base 122 and/or spaced non-uniformly within one or more rows.

Water flow through the second showerhead 200, at least to the bottom side of the shutter 134, generally proceeds as previously described above for the first showerhead 100. Also as previously described above for the first showerhead 100, selective engagement of the shutter engagement feature 174 with the housing engagement feature 176 causes the shutter 134 to rotate at a slower speed than the turbine 132. As the shutter 134 rotates inside the chamber 126 of the housing 102, one or more shutter fluid openings 202 may pass over one or more rows of fluid passage openings 206 in the housing 102. This permits water to temporarily flow through the unobstructed fluid passage openings 206. Thus, as the shutter 134 rotates, water flow through the outlets or nozzles 110 is periodically interrupted as the solid portion of the shutter 134 temporarily obstructs the water flow through those outlets 110 in fluid communication with fluid passage openings 206 located under the solid portion of the shutter 134. This creates a pulsating flow of water from the showerhead 200.

Various embodiments of the second showerhead 200 may use the same or differing numbers of fluid passage openings 206 to outlets or nozzles 110. For example, each outlet 110 may be in fluid communication with a single fluid passage opening 206, or an outlet 110 may be in fluid communication with two or more fluid passage openings 206, or vice versa.

Figure 26:
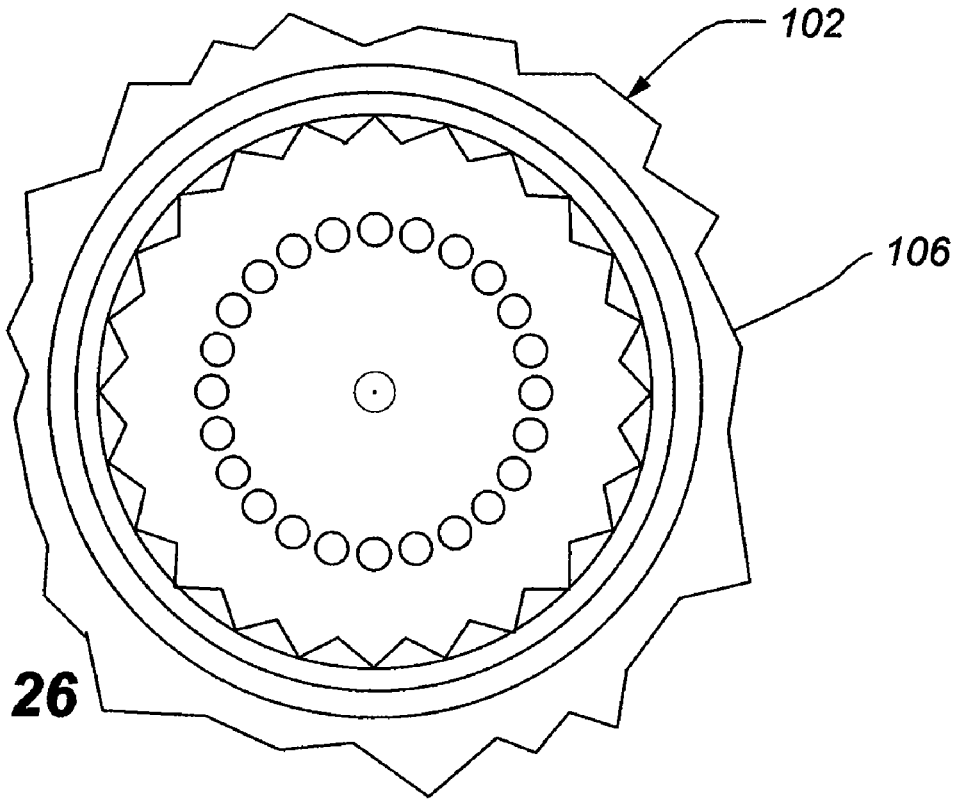
FIG. 26 depicts a top view of another housing for the showerhead shown in FIG. 16.
Figure 27:
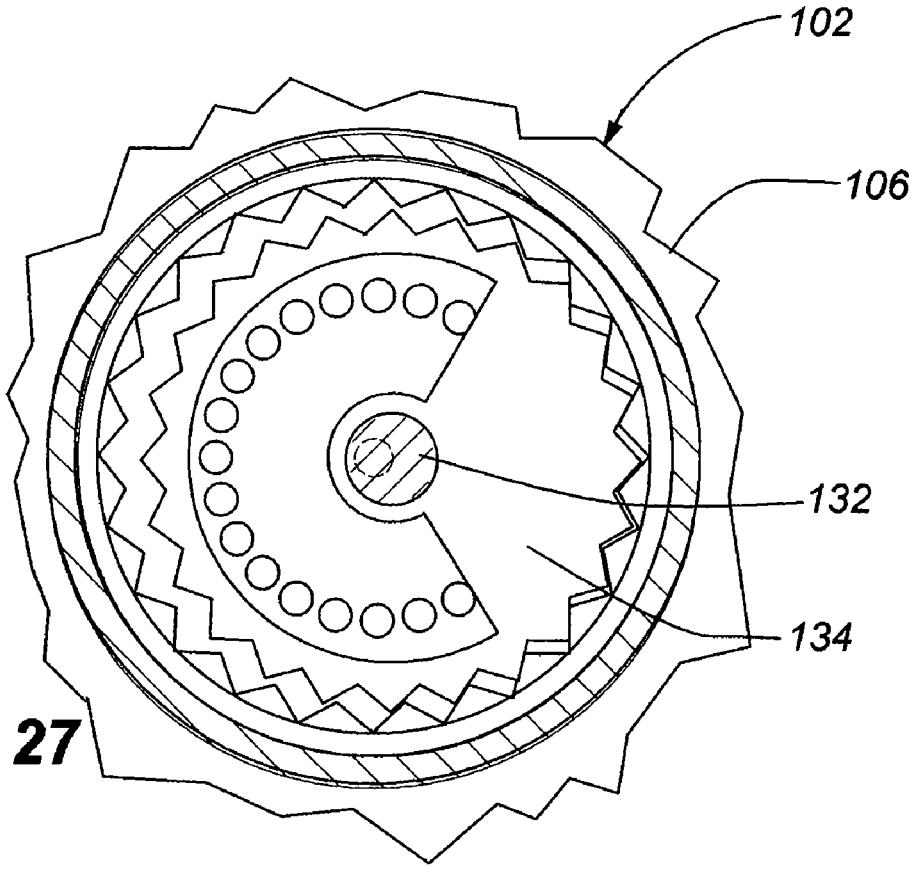
FIG. 27 depicts another cross-section view of the showerhead shown in FIG. 16 similar to the view shown in FIG. 18, showing another shutter for the showerhead shown in FIG. 16 positioned within the housing shown in FIG. 26.

Other embodiments of the showerhead, including variations of the first and second showerheads 100, 200, may use other types of engageable features on the shutter 134 and the housing 102 to cause the shutter 134 to rotate at a different rate than the turbine 132. For example, the shutter 134 may have external, involute teeth and the housing 102 may have matching internal, involute housing teeth. As another example, the shutter 134 may have saw tooth features that mate to saw tooth cuts in the housing 102 as depicted in FIGS. 26 and 27. In yet another example, circular pins extending radially from the periphery of the shutter 134 may mate with slots in the housing 102. As yet another example, slots in the shutter 134 may mate with pins extending radially inward from the housing 102. As still yet another example, circular cuts in the periphery of the shutter 134 may engage pins in the housing 102. The foregoing examples are merely illustrative and are not intended to limit the engageable features for the shutter 134 and/or the housing 102 to any particular feature, or to limit other mechanisms for causing the shutter 134 to rotate at different rate than the turbine 132.

Further, the engagement of the shutter 134 to the housing 102 is generally not limited to the use of engagement features 174, 176 to implement the speed reduction mechanism or to otherwise change the rotational speed of the shutter 134 relative to the turbine 132. In some embodiments, the shutter 134 may be made to lag the turbine 132 through friction engagement between the shutter 134 and housing 102. In such embodiments, the speed reduction may be determined by the ratio of the difference in the diameters of the housing 102 and the shutter 134, divided by the diameter of the shutter 134 (presuming minimal to no slippage between the shutter 134 and the housing 102).

The housing 102, shutter 134, jet disk 130, turbine 132, and other elements for any embodiment of a showerhead may be integrally formed or may be made of two or more separate components that are joined together by mechanical fasteners, sonic or heat welds, adhesives, chemical bonds, any other suitable method, or any combination thereof. Further, the components may be formed from any suitable material, including, but not limited to, plastics, metals, elastomers, and so on.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the invention, and do not create limitations, particularly as to the position, orientation, or use of the invention unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present invention is not limited to components which terminate immediately beyond their point of connection with other parts. Thus the term "end" should be broadly interpreted, in a manner that includes areas adjacent rearward, forward of or otherwise near the terminus of a particular element, link, component, part, member or the like. In methodologies directly or indirectly set forth herein, various steps and operations are described in one possible order of operation but those skilled in the art will recognize the steps and operation may be rearranged, replaced or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A showerhead, comprising:

a housing defining a chamber in fluid communication with a fluid inlet and at least one fluid outlet, wherein the housing further defines a first engagement feature;

a turbine received within the chamber; and a shutter received within the chamber, wherein the shutter defines a second engagement feature and the shutter is operatively associated with the turbine, wherein rotation of the turbine causes rotation of the shutter;

the direct engagement of the first engagement feature with the second engagement feature causes a rotation rate of the shutter to be less than a rotation rate of the turbine; and as the shutter rotates, the shutter fluidly connects and disconnects the fluid inlet and the at least one fluid outlet.

2. The showerhead of claim 1, wherein the first engagement feature comprises at least one gear tooth.

3. The showerhead of claim 1, wherein the second engagement feature comprises at least one gear tooth.

4. The showerhead of claim 1, wherein the first engagement feature comprises a first number of gear teeth, and the second engagement feature comprises a second number of gear teeth.

5. The showerhead of claim 4, wherein the first number is greater than the second number.

6. The showerhead of claim 1, wherein the shutter comprises a substantially circular disk, and the second engagement feature is positioned proximate a periphery of the disk.

7. The showerhead of claim 1, wherein the shutter includes at least one opening and at least one solid portion;

the at least one opening fluidly connects the fluid inlet and the at least one fluid outlet and the at least one solid portion disconnects the fluid inlet and the at least one fluid outlet.

8. The showerhead of claim 1, wherein the at least one fluid outlet comprises a first row of outlets and a second row of outlets.

9. The showerhead of claim 8, wherein the shutter includes a first opening, a second opening, and a solid portion;

the first opening fluidly connects the first row of outlets with the fluid inlet;

the second opening fluidly connects the second row of outlets with the fluid inlet; and the solid portion disconnects the first row of outlets and the second row of outlets with the fluid inlet.

10. The showerhead of claim 1, wherein the turbine and the shutter rotate in opposite directions.

11. The showerhead of claim 1, wherein the turbine and the shutter rotate in the same direction.

12. The showerhead of claim 1, wherein the rotation rate of the shutter is no greater than approximately $1/15^{th}$ of the rotation rate of the turbine.

13. The showerhead of claim 1, wherein the turbine includes an eccentric cam, and the shutter includes an opening for receiving the cam.

14. The showerhead of claim 1, wherein a center of the shutter moves in a substantially circular path around a center of the turbine.

15. The showerhead of claim 1, further comprising a jet disk operatively associated with the turbine, and the jet disk includes at least one jet.

16. The showerhead of claim 1, wherein the first engagement feature comprises an integer number of engagement features incorporated within an inner surface of the housing defining the chamber;

the shutter comprises a disk and the second engagement feature comprises an integer number of engagement features distributed around a periphery of the disk;

the integer number of the first engagement features is different than the integer number of the second engagement features; and rotation of the shutter selectively engages the second engagement features with the first engagement features.

17. The showerhead of claim 16, wherein the number of second engagement features is less than the number of first engagement features.

18. The showerhead of claim 17, wherein the rate of rotation of the shutter is the rate of rotation of the turbine multiplied by a speed reduction factor.

19. The showerhead of claim 18, wherein the speed reduction factor is the difference between the number of first engagement features and the number of second engagement features divided by the number of second engagement features.

20. The showerhead of claim 4, wherein the second number is greater than the first number.

* * * * *